US006349854B1

(12) United States Patent
Bierend et al.

(10) Patent No.: US 6,349,854 B1
(45) Date of Patent: Feb. 26, 2002

(54) UTILITY-POWER OPERATED PRESSURIZED SPRAY CAN

(76) Inventors: Steven J. Bierend, 530 Parkview North, Santa Maria, CA (US) 93455; Clyde L. Tichenor, 905 N. Oak Ave., Fillmore, CA (US) 93015; Irwin Ginsburgh, 24125 Clearbank La., Newhall, CA (US) 91321

( * ) Notice: Subject to any disclaimer, the term of this patent is extended or adjusted under 35 U.S.C. 154(b) by 0 days.

(21) Appl. No.: 08/875,673

(22) PCT Filed: Mar. 15, 1995

(86) PCT No.: PCT/US95/03545

§ 371 Date: Jan. 22, 1998

§ 102(e) Date: Jan. 22, 1998

(87) PCT Pub. No.: WO95/25022

PCT Pub. Date: Sep. 21, 1995

(51) Int. Cl.[7] ..... B67D 5/33

(52) U.S. Cl. ..... 222/153.11; 222/402.11; 222/464.1; 222/504; 251/89; 251/129.2; 137/590

(58) Field of Search ..... 222/504, 153.11, 222/153.14, 153.13, 402.1, 402.11, 402.15; 251/89, 129.01, 129.2, 65; 239/337, 580, 583; 137/590, 383

(56) References Cited

U.S. PATENT DOCUMENTS

| | | | | | |
|---|---|---|---|---|---|
| 3,666,144 | A | * | 5/1972 | Winder | 222/504 |
| 4,483,466 | A | * | 11/1984 | Gutierrez | 222/504 |
| 5,294,022 | A | * | 3/1994 | Earle | 222/504 |
| 5,318,208 | A | * | 6/1994 | Van Der Wal | 222/504 |
| 5,385,271 | A | * | 1/1995 | Bierend et al. | 222/153.14 |
| 5,427,277 | A | * | 6/1995 | Bierend et al. | 222/504 |

* cited by examiner

*Primary Examiner*—Kevin Shaver
*Assistant Examiner*—Patrzck Buechner
(74) *Attorney, Agent, or Firm*—Albert O. Cota

(57) ABSTRACT

An aerosol spray can (12) that can only be operated when connected to an a-c utility power source provided by a power cord (50A) connected to an external activator (40). The can is modified by adding internally, a movable armature (19) that operates a valve assembly (16) connected to a spray head (20). When the armature is not energized by the attached activator (40), the valve assembly (16) remains in a closed position, preventing the flow of paint. Conversely, when the movable armature (19) is energized by the activator (40), the valve assembly (16) opens allowing paint to be sprayed when the spray head (20) is depressed.

24 Claims, 14 Drawing Sheets

UTILITY-POWER OPERATED PRESSURIZED SPRAY CAN

TECHNICAL FIELD

The invention pertains to the general field of pressurized spray cans and more particularly to an aerosol paint spray can that can only be operated when it is connected by means of an a-c power cord, to an a-c utility power source.

BACKGROUND ART

The use of graffiti to deface various types of surfaces is wide spread both in cities of the United States of America and cities of many other industrialized world nations. Graffiti can consist of any unauthorized name, word or symbol or any combination thereof that is placed on a public or private surfaces by so called "graffiti taggers". Graffiti taggers have been around and have marked public surfaces since the days of the Pharaohs—even the pyramids did not escape this aesthetic plaque. Today, there is hardly a blank wall in inner cities, such as in central Los Angeles, that does not display some form of graffiti.

The primary target areas for graffiti taggers include public and private businesses, street and freeway signs, subways, trains and buses. To curtail the application of graffiti, several plans, devices and activities have been implemented: in Los Angeles, for instance, 4,000 people participated in a graffiti paint-out spearheaded by the Los Angeles Police Department. In one morning, the volunteers used 1700 gallons of paint and eradicated 62,000 feet of graffiti. The work of both public and private graffiti cleanup efforts are evident across the city in patchwork squares of unmatched paint on walls and buildings. As well meaning as cleanup techniques are, statistics have shown that when graffiti are covered in patches, the patches are invitations to graffiti vandals. Thus, graffiti is three times as likely to reappear then if the wall were all one color. To prevent street and particularly high-rise freeway signs from being marked razor wire has been placed around the signs access areas. The Transit Authorities of the various cities have taken cars out of service for cleaning as soon as they were marred by graffiti, no matter how slight the marking. Guards and dogs have also been posted in Yards where these vehicles are stored for cleaning and maintenance.

To implement graffiti removal and watch programs has been costly for city governments. Most of the money goes to pay for crews that respond to the complaints by home-owners and businesses. Last year, the Los Angeles county government spent over $10 million trying to clean up the graffiti. The city of Los Angeles spent another $4 million, and the Southern California Rapid Transmit district spent $5 million. These figures are in addition to the money spent by various police agencies in chasing and arresting graffiti taggers. In New York, the Transit Authority has spent $6 billion in subway cleanup campaigns. Workers spend an average of 110 hours a week cleaning spray-paint off subway cars. In subways, it has been estimated that the national cost for controlling graffiti will exceed $4 billion. In addition to the cost involved in trying to eradicate graffiti, there is also the cost involved in decreased property values and in the more intangible psychic costs of living in a city that looks as though it is under siege.

Graffiti taggers use ballpoint pens, felt-tip markers and aerosol spray cans to perform their work with spray cans being the marker of choice. Over the years there have been various efforts to control graffiti by clamping down on the use of aerosol paint spray cans. According to the paint industry about 41,400 of these paint spray cans with a retail value of $120,000 are sold each day in Los Angeles, Orange, Riverside and San Bernardino Counties. By another estimate, more than 8,000 of these spray cans are used daily to deface property nationwide. To curtail the adverse use of spray cans, laws have been passed or are in process of passage to keep spray cans locked up, making these cans unavailable for purchase by persons under the age of 18 and even to ban the sale of spray paint cans statewide, except those used by commercial firms. An outright ban is, of course, unfair to both the manufacturers and retailers—and most likely ineffective.

A search of the prior art did not disclose any patents or other literature that read directly on the claims of the instant invention. Particularly, no patents were found that disclosed aerosol paint spray cans that can only be operated when connected to a utility power source. However, the following U.S. patents were considered related:

| U.S. Pat. No. | INVENTOR | ISSUED |
|---|---|---|
| 5,385,271 | Bierend, et al | January 31, 1995 |
| 5,318,208 | Van der Wal | June 7, 1994 |
| 5,014,884 | Wonsch | May 14, 1991 |
| 4,972,975 | Fuhrig | November 27, 1990 |
| 4,971,257 | Birge | November 20, 1990 |

The U.S. Pat. No. 5,385,271 Bierend et al patent discloses an aerosol spray can that is modified by the attachment of a valve. The valve has an upper fluid port to which is attached a spray head and a lower fluid port that is attached to a valve attachment port on the spray can. The valve is operated by an a-c utility power supplied through a power cord. When power is not applied, the valve is positioned to prevent the fluid in the can from being sprayed. Conversely, when power is applied, the valve is repositioned to allow the fluid in the can to be sprayed when the spray head is depressed.

The U.S. Pat. No. 5,318,208 Van der Wal patent disclose an aerosol spray can that is operated by a handgrip releasably attached to a modified spray can. The handgrip which can only be operated when it is connected to a 120-volt a-c power receptacle, includes a manually operated trigger. The trigger controls the application of the a-c power to a solenoid located within the handgrip. When the solenoid is activated, a first valve and a second valve are sequentially opened to allow the paint in the spray can to be sprayed.

The U.S. Pat. No. 5,014,884 Wonsch patent discloses an aerosol spray can that includes a spray mechanism for finely atomizing fluids through a hydraulically-operated pump. The spray mechanism is inserted into a housing which is connected with the supply container for the liquid through a close-fitted or frictional locking connection. The spray mechanism incorporates a battery operated gear pump in which, the suction line of the pump is connected through an opening in the bottom of the housing into the supply container. The supply container is equipped with a venting line, whereby the gear pump includes a pressure tube at its output which is connected with a discharge nozzle.

The U.S. Pat. No. 4,972,975 Fuhrig patent discloses a housing that stores a battery that powers an electric motor that operates a compressor for producing compressed air in combination with a suction unit and a pressure joint. A product container that includes a spray nozzle is placed inside the housing with a connection between the pressure joint of the compressor and the interior of the product container. The compressor pressurizes the product container through an aperture thereby forcing the liquid through the container spray nozzle.

The U.S. Pat. No. 4,971,257 Birge patent discloses an electrostatic particle spraying apparatus. The apparatus includes a hand held triggering mechanism that includes a d-c power source and a coupling sleeve into which a conventional aerosol spray can is inserted when the triggering mechanism is squeezed, a hammer depresses the nozzle tip of the aerosol can, releasing the pressurized fluid of the can from the nozzle tip.

This application is also related to the applicant's copending application Ser. No. 08/095,851, filed Jul. 23, 1993 and entitled Utility-Power Operated Aerosol Spray Can.

The U.S. Pat. No. 5,385,271 Bierend, et al patent and the U.S. Pat. No. 5,308,208 Van der Wal patent as well as U.S. patent application Ser. No. 08/212,939 filed Mar. 15, 1994 and the present application are all assignees of the present invention. The U.S. Pat. Nos. 5,385,271 and 5,308,208 are incorporated herein by reference thereto.

For background purposes and indicative of the art to which the invention relates, reference may be made to the following remaining patents found in the pre-examination search:

| U.S. Pat. No. | INVENTOR | ISSUED |
|---|---|---|
| 5,069,391 | Seasholtz | December 3, 1991 |
| 4,618,099 | Nagad et al | October 21, 1986 |

DISCLOSURE OF THE INVENTION

The utility-power operated, pressurized spray can is designed to dispense a fluid only if an energizer or activator is attached to the can and the activator is connected by means of a power cord, to a utility a-c power receptacle. Therefore, "graffiti taggers" are prevented from using spray cans in areas not having access to an a-c power source. Thus, the use of spray cans to spray graffiti is greatly reduced or eliminated. In its most basic design configuration, the utility-power operated, pressurized spray can consists of:

A. A pressurized spray can having a spray head opening that includes an upper end and a lower end. To the upper end is attached a spray head and to the lower end is attached an internal spray control valve means.

B. An internal spray control valve means that is adapted to be attached to the lower end of the spray head opening. The control valve has a lower end adapted to receive the fluid contents of the spray can and means for controlling the paint flow therethrough.

C. An armature means mounted on a non-magnetic housing. The armature includes a means for being biased in a first, at rest, position and has an upper surface to which is mounted the internal spray control valve means.

D. An external armature activator means adapted to surround the pressurized spray can and adapted to be connected to an a-c utility power source. When power is applied to the activator, an electromagnetic coil located within the activator means is activated. This coil activator causes the armature means to move from its at rest position which then allows the spray control valve means to allow paint to be applied to the spray head stem.

A further development of the above basic design consists of a utility-power operated, pressurized spray can consisting of:

A. A pressurized spray can consisting of:

(1) an upper section having a spray head stem opening into which is inserted a spray head, and (2) a spray control valve having an upper end that terminates at the spray head stem opening and a lower end that is connected to a free standing paint siphon tube, B. A movable armature dimensioned to traverse longitudinally through a non-magnetic housing. The armature is spring biased to remain in a normal upward position, C. A valve assembly that controls the paint flow through the siphon tube, and that is movably attached to an upper surface of the movable armature. The valve assembly is designed to be placed in either a downward open position or an upward closed position, and D. An external, separable movable-armature activator that is dimensioned to be placed around the pressurized spray can within the volume encompassing the movable armature. The activator is designed to be connected to an a-c utility power source. When the activator is not connected, the movable armature remains in an upward position and conversely, when the activator is connected, the movable armature moves downward. The downward movement causes the valve assembly to move to its downward position which then allows paint to be sprayed when the spray head is depressed.

The design of the utility-power operated pressurized spray can is disclosed in a first embodiment and a second embodiment. The first embodiment is further disclosed in two designs that feature a valve assembly that is located above the upper surface of the spray can. The second embodiment is further disclosed in three designs that utilize a valve design that is located at the bottom of the can In the first embodiment, the external activator includes a pistol grip handle; and in the second embodiment the activator is placed over the bottom section of the spray can.

The invention is also disclosed with two movable armature designs. In a first design, the armature moves longitudinally and in the second design, it rotates. In both designs, the armature when activated by the activator, moves from an at rest, position to a downward position. When positioned downward, the valve assembly opens allowing paint to be sprayed when the spray head is depressed.

In the third design of the second embodiment, the spray head is not depressed when paint is to be dispensed instead an electrical switch is used to energize the activator. As long as the switch is depressed, paint will be sprayed. This design also eliminates the need for the standard spray control valve used on conventional spray cans.

All of the above embodiments can be manufactured with an activator that includes an electro-mechanical assembly. The assembly allows power to be applied to the activator only when a can is attached to the activator and the activator is raised above a surface.

In view of the above disclosure, it is the primary object of the invention to provide an aerosol spray can that can only be operated when the can is connected to an a-c utility power source. Because of the a-c power requirement, the average spray paint graffiti tagger will be unable to spray graffiti in most outdoor locations. In addition to the primary object of the invention, it is also an object of the invention to provide an aerosol spray can that:

is designed so that if a graffiti tagger attempts to connect a magnet or a d-c battery to the solenoid housing, the linear-motion solenoid assembly will not function and paint cannot be sprayed, if a tagger attempts to puncture the solenoid housing, the puncture will quickly depressurize the can and create an uncontrolled paint flow at the puncture opening, is reliable and maintenance free, is cost effective from both a manufacturers and consumers point of view, and will save countless manhours and costs expended in the removal of graffiti from various structures.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
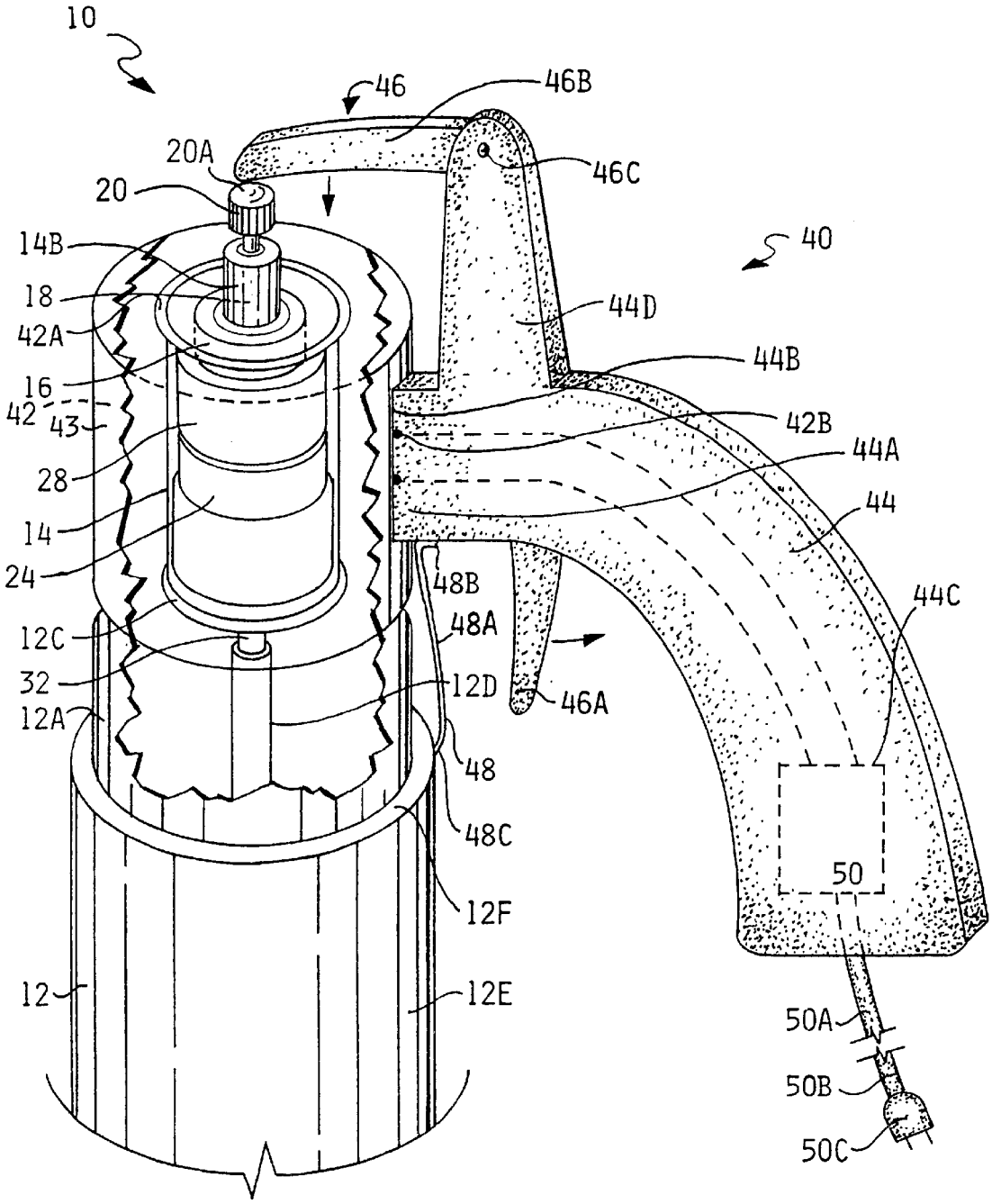
FIG. 1 is a perspective view of a first embodiment of the utility-power operated pressurized spray can.

The best mode for carrying out the invention is presented in terms of a first embodiment and a second embodiment. The first embodiment is disclosed in two designs that have a valve assembly above the upper surface of the spray can. The second embodiment is disclosed in three designs that have a valve assembly located at the bottom of the spray can. In either embodiment, it is the purpose of the invention to produce a spray can that can only be operated when a-c utility power is applied to an external activator that must be placed over the spray can before the can is used. Thus, its use for spraying graffiti is eliminated or significantly curtailed.

The first embodiment of the utility-power operated, pressurized spray can 10 is presented in FIGS. 1–12 and is comprised of the following major elements: a pressurized spray can 12; a solenoid housing 14; a valve assembly 16 consisting of a stationary valve section that also functions as a spray control valve retaining structure 17 and a spray control valve 18; a separable spray head 20; a linear-motion solenoid assembly 22 consisting of a stationary armature 24, a spring 26 and a movable armature 28; a valve leaf 30 that comprises the movable valve section of the valve assembly 16; a paint guide tube 32; and an external, separable movable-armature activator 40.

Figure 2:
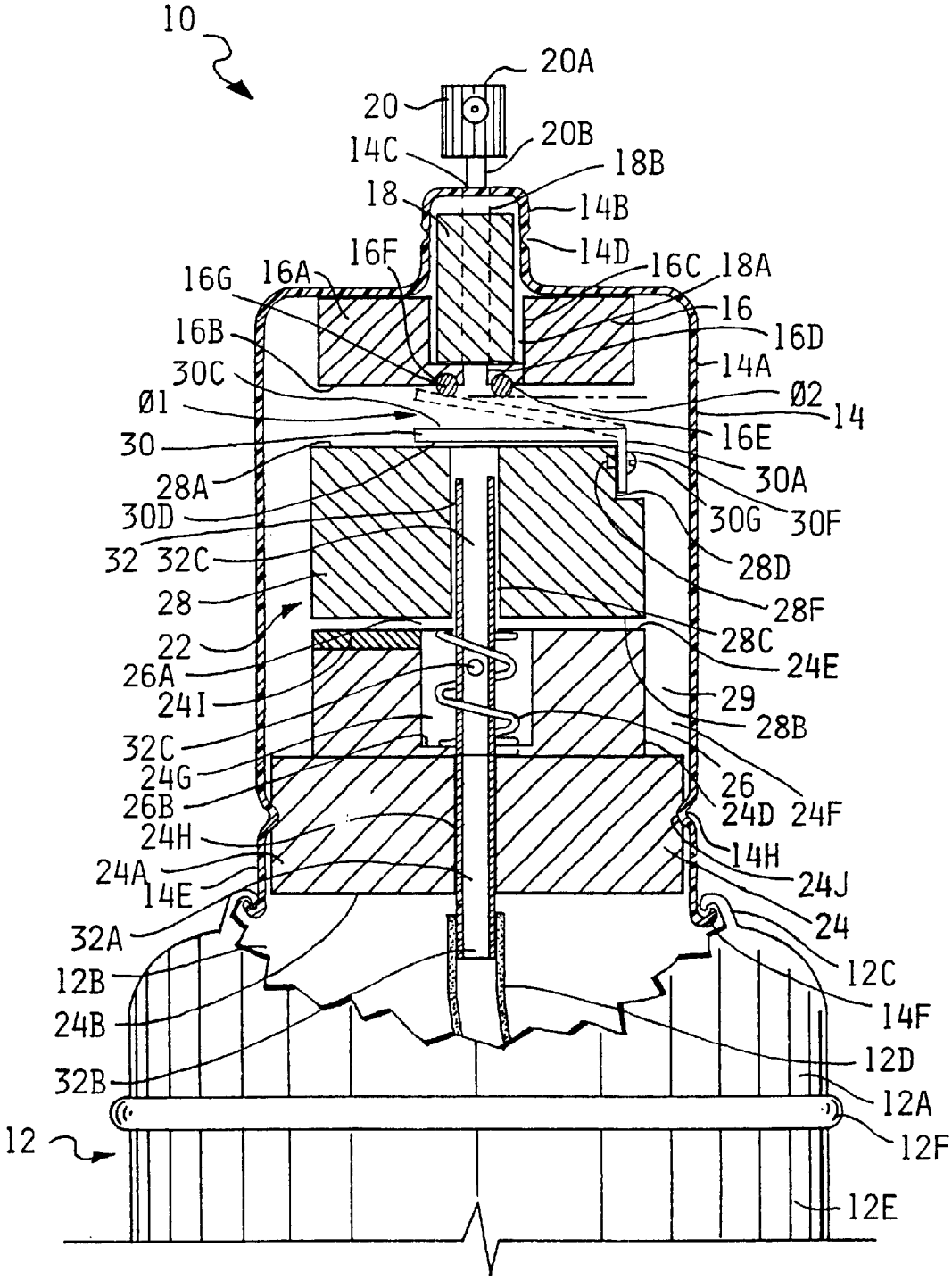
FIG. 2 is an elevational, sectional view of the first embodiment of the utility-power operated pressurized spray can as depicted in FIG. 1, showing the relative placement of the principle elements of the invention.

The pressurized spray can 12 used in the first embodiment consists of an upper section 12A and a lower section 12E as shown in FIGS. 1 and 2. The upper section 12A has a housing opening 12B as shown in FIG. 2, that includes around its circumferential perimeter, a first attachment seam 12C. The lower section 12E attaches to the upper section 12A by means of an attachment ring 12F. The final element that comprises the pressurized spray can 12 is a liquid siphon tube 12D that is uprightly located therein as shown in FIG. 2, and from where paint is siphoned from the bottom of the spray can 12.

The solenoid housing 14 which is preferably constructed of a non-magnetic material, consists of a top section 14A and an open bottom section 14E. The top section 14A as best shown in FIG. 2, includes an integral upper protuberance 14B that has at its top end a spray head stem opening 14C. The open bottom section 14E of the housing has at its perimeter edge, a second attachment seam 14F, that is designed to interface with and lock to the first attachment seam 12C on the spray can 12.

The spray control valve retaining structure 17 which also functions as the stationary section of the valve assembly 16 as shown in FIG. 2, includes an upper surface 17A, a lower surface 17B and, a valve retaining cavity 17C. The cavity is recessed into the upper surface 17A and is centrally located under the protuberance 14B on the housing 14. The retaining cavity 17C also includes a substantially centered paint passage bore 17D extending from the bottom of the cavity recess to the bottom of the spray control valve retaining structure 17. Within the upper protuberance 14B and into the retaining cavity 17C is located a standard spray control valve 18.

The spray control valve 18, as also best shown in FIG. 2, is inserted into the valve retaining cavity 17C and attached therein by an attachment means 18A that preferably consists of an adhesive. The valve 18 is also held within the protuberance 14B by a valve crimp 14D as also shown in FIG. 2. The valve 18 includes a paint passage channel 18B that interfaces with the paint passage bore 17D on the valve retaining structure 17 and is designed to operate with a separable spray head 20. This spray head has an upper surface 20A and a downward, hollow stem 20B that is inserted into the paint passage channel 18B on the standard spray control valve 18, when the spray head 20 is depressed, the valve opens.

Located on the lower surface 17B of the valve retaining structure 17, around the paint passage bore 17D, is a paint passage sealing means 17E that operates in combination with a valve leaf 30 that comprise the movable section of the valve assembly 16. The valve leaf is described infra. The two elements of the valve assembly are located in series with the standard spray control valve 18. The paint passage sealing means 17E of the valve assembly 16 is disclosed in three designs.

Figure 6:
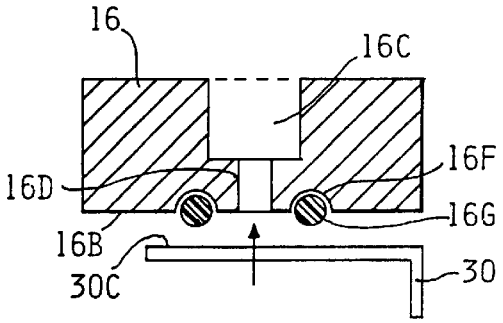
FIG. 6 is an elevational, sectional view showing a first design of a paint sealing means consisting of an o-ring and a valve leaf.

The first design as shown in FIG. 6, comprises an o-ring channel 17F that is centrally located on the lower surface 17B of the valve retaining structure 17 around the paint passage bore 17D. Into the o-ring channel 17F is partially inserted a resilient o-ring 17G that is attached therein by an attachment means that preferably consists of an adhesive. When the movable armature 28 is in its de-energized, upward position, the o-ring 17G functions to seal against the valve leaf 30 and seal the paint passage bore 17D. Thus, preventing paint flow through the spray control valve 18.

Figure 7:
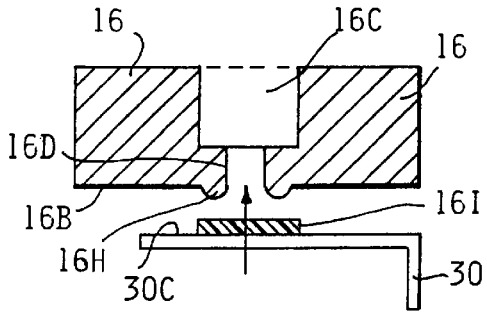
FIG. 7 is an elevational, sectional view showing a second design of a paint sealing means consisting of a high-unit pressure ring and a compliant pad that is attached to the valve leaf.
Figure 8:
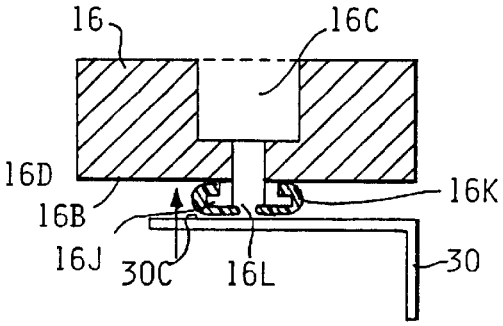
FIG. 8 is an elevational, sectional view showing a third design of a paint sealing means consisting of a an expanded bore lip attached around the perimeter of the paint passage bore and a compliant ring that is attached to the valve leaf.

The second design as shown in FIG. 7, comprises a a downward extending lip 171 and a compliant pad 17I. The lip 17H is centrally fixed to the lower surface 17B of the valve retaining structure 17 around the paint passage bore 17D and the compliant pad 17I attached to the upper surface of the valve leaf 30. When the movable armature 28 is placed in its de-energized, upward position, the lip 17H contacts the compliant pad 17I to seal and prevent paint flow through the spray control valve 18.

The third and final design disclosed for the paint passage sealing means 17E is comprised of an expanded bore lip 17J that is attached around the perimeter of the paint passage bore 17D. Around the lip 17H is mounted and held a stretchable compliant ring 17K having a paint passage bore 17D and that functions as an o-ring. When the movable armature 28 is placed in its de-energized, upward positions, the compliant ring 17K makes contact with the upper surface 30C of the valve leaf to seal the paint passage bore 17D. Thus, preventing paint flow through the spray control valve 18.

Below and in series with the spray control valve 18 and the paint passage sealing means 17E is the linear-motion solenoid assembly 22 which consists of a stationary armature 24, a spring 26 and a movable armature 28.

The stationary armature 24 has a lower section 24A having a bottom surface 24B and a diameter, that allows the stationary armature 24 to tightly fit into the solenoid housing 14. When so fitted, the bottom surface 24B is positioned near the lower perimeter edge of the housing as best shown in FIG. 2.

The stationary armature 24 is attached to the solenoid housing 14 by an attachment means 14G,24C. Preferably, this attachment means consists of a male crimp ring 14H and a female crimp ring 24J. As shown in FIG. 2, the male crimp ring 14H is located around the perimeter of the solenoid housing 14 above the second attachment seam 14F. The female crimp ring 24J is located around the perimeter of the stationary armature 24 in alignment with the male crimp ring 14H. When the stationary armature 24 is inserted into the open bottom section 14E of the housing 14 and the pair of crimp rings 14H,24J interface, the stationary armature 24 is rigidly attached.

The stationary armature 24 also includes an integral upper section 24D having a top surface 24E and a smaller diameter than that of the lower section 24A. The smaller diameter allows a space 24F to exist between the upper section 24D and the solenoid housing 14. Extending downward from the top surface 24E of the upper section 24D is a substantially centered spring cavity 24G into which is inserted a spring 26. Through the bottom of the spring cavity 24G and through the lower section 24A of the stationary armature 24 is a lower guide tube bore 24H. Also, extending horizontally across the top surface 24E of the stationary armature 24 from one side of the spring cavity 24G to the edge of said stationary armature 24, is a paint flow channel 24I.

The second element of the linear-motion solenoid assembly 22 is the movable armature 28. The movable armature has a top surface 28A, a bottom surface 28B and a diameter that is substantially equal to the smaller diameter of the upper section 24D of the stationary armature 24. The smaller diameter of the upper section 24D of the stationary armature 24 and the like diameter of the movable armature 28 creates a space 29 between the surface of the two armatures and the inside wall of the housing 14 as shown in FIG. 2. This space precludes an individual from trying to energize the solenoid assembly 22 by holding a permanent magnet (not shown) against the surface of the solenoid housing 14. Through the armature 28 is located an upper guide tube bore 28C that has a slightly larger diameter than that of the lower guide tube bore 24H on the stationary armature 24.

Figure 3:
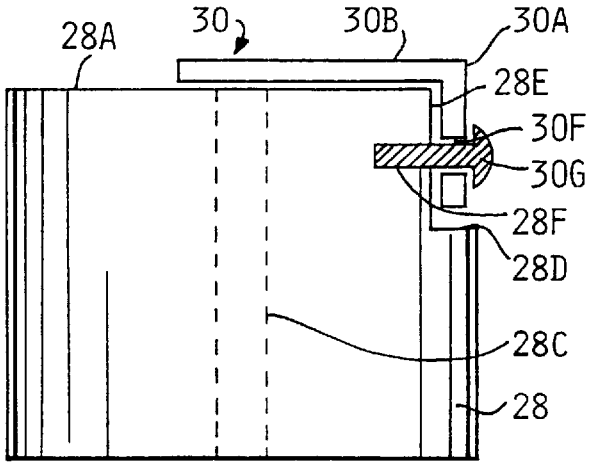
FIG. 3 is an elevational view of the movable armature with a valve leaf attached.

Located in chord relationship on one side of the movable armature 28 is a valve leaf attachment step 28D having a vertical side 28E to which is attached, as shown in FIG. 3, the non-magnetic valve leaf 30. The valve leaf is configured in an L-shape with a vertical section 30A and a horizontal section 30B. The vertical section 30A is loosely coupled, by an attachment means, to the vertical side 28E of the attachment step 28D. The attachment means preferably consists, as shown in FIG. 3 of a leaf pin bore 30F located through the vertical section 30A of the valve leaf 30. A slightly smaller step pin bore 28F is located on the vertical side 28E of the valve leaf attachment step 28D. A spiraled pin or a press-fit pin 30G is then loosely inserted through the leaf pin bore 30F and tightly into the step pin bore 28F to loosely couple the valve leaf 30 to the valve leaf attachment step 28D.

The horizontal section 30B of the valve leaf 30 as shown in FIG. 2, is movably positioned in either an open position Ø1 or a closed position Ø2 (shown in dashed lines) between the valve sealing means on the lower surface 30D of the valve retaining structure 17 and the top surface 28A of the movable armature 28. The movable armature 28 is designed to be maintained in a normal, de-energized, upward position by the spring 26 and the paint pressure. In this normal position, the top surface 28A of the movable armature 28 makes contact with the valve leaf 30, placing the valve leaf in its closed position Ø2. When the movable armature 28 is placed in its energized, downward position by the activator 40 as described infra, the bottom surface 28B of the movable armature 28 makes contact with the top surface 24E of the stationary armature 24. This action, causes the leaf spring 30 to move to its open position Ø1 as shown in FIG. 2, which then allows paint to flow through the paint passage bore 16D and paint passage channel 18B.

The valve leaf 30 is designed to function as a first class lever in relation to the o-ring 17G or the other disclosed designs of the paint passage sealing means 17E. This lever provides both a force multiplier and a "break seal" function. Hydraulic theory dictates that when the valve leaf 30 seals against the fluid flow on the o-ring 17G, there is a hydraulic pressure exerted on the valve leaf 30 which corresponds to the internal pressure of the spray can which ranges between 70–80 psi. This pressure normally exceeds the electromagnetic force produced by the electromagnetic coil 42 of the external, separable movable-armature activator described infra. However, in the instant invention, the valve leaf 30 is loosely coupled to the movable armature 28 as shown in FIGS. 2 and 3. Therefore, when the movable armature 28 is placed in its energized, downward position, a first class lever condition is created using the drive energy of the press-fit pin 30G of the valve leaf attachment means against the opposite side of the o-ring 17G. This leverage ratio breaks the seal condition on the opposite side of the o-ring 17G and releases the hydraulic pressure. Thus, causing the valve leaf 30 to move to its open Ø1 position.

Figure 9:
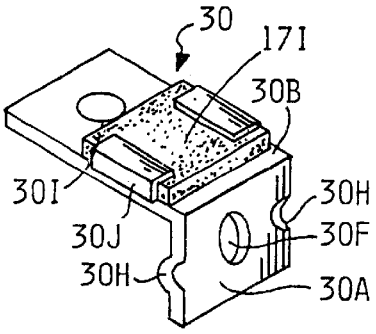
FIG. 9 is a perspective view of the valve leaf showing the locations of a dimple and a pair of pivot indentations. This figure also shows a compliant pad attached to the valve leaf by means of tabs.
Figure 10:
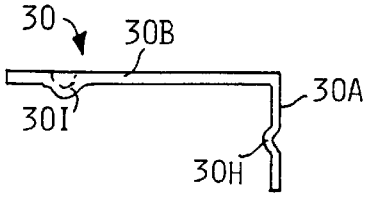
FIG. 10 is a side elevational view of the valve leaf showing the location of the dimple and the pair of pivot indentations.

To further enhance the utility of the valve leaf 30 it may be designed to include a pair of pivot indentations 30H as shown in FIGS. 9 and 10. These indentations are aligned horizontally with respect to the center of the leaf pin bore 30F and extend inward from each side of the leaf's vertical section 30A. The pivots 30H facilitate the pivoting action of the valve leaf 30 from an energized position to a de-energized position and vice versa while limiting sideward movement. The indentations also allow the precise alignment of the valve leaf and the paint passage sealing means.

The valve leaf may further include a dimple 30I, as also shown in FIGS. 9 and 10, that extends downward from its lower surface 30D and that is concentrically aligned with the paint passage bore. The dimple provides a means for allowing tiltable alignment of the valve leaf 30 with the paint passage sealing means. In FIGS. 7 and 9 respectively, is also shown a compliant pad 17I held in place by an adhesive 30K or a plurality of tabs 30J.

The paint flow is accomplished through the non-magnetic paint guide tube 32 which includes a lower section 32A and an upper section 32D.

The lower section 32A is press-fitted into the lower guide tube bore 24H on the stationary armature 24. The lower section 32A also has a lower end 32B that projects through the bottom surface of the stationary armature as shown in FIG. 2 and is inserted into the siphon tube 12D located within the spray can 12. The lower section 32A further has within a distance confined by the length of the spring cavity 24G, the paint passage opening 32C. This opening, allows a secondary paint flow to exit and flow through the paint flow channel 24I on the stationary armature 24. The upper section 32D projects upward from the top surface 24E of the stationary armature 24 and into the slightly larger diameter upper guide tube bore 28C on the movable armature 28. In addition to functioning as a paint flow means, the paint guide tube 32 also functions as a guide for the movable armature 28.

The fourth and final element that comprises the linear-motion solenoid assembly 22 and which is the key to operate the assembly 22 is the external, separable, movable-armature activator 40 as shown in FIG. 1. This assembly is comprised of an electromagnetic coil 42, a non-magnetic outer coil casing 43, a handle 44, a magnetic conductive coil casing 45, a trigger structure 46, an attachment means 48 and an electronic power circuit 50.

Figure 4:
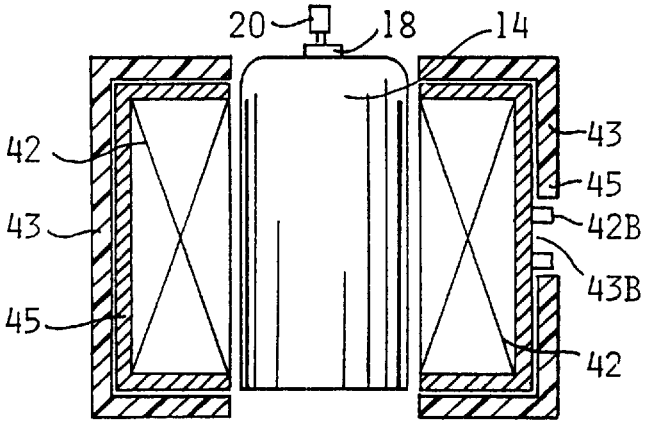
FIG. 4 is an elevational view showing the electromagnetic coil casing as placed around the electromagnetic coil.

The electromagnetic coil 42 is designed with a center attachment opening 42A that is sized to snugly fit over the diameter of the solenoid housing 14; a length that substantially encloses the length of the housing 14 and pair of coil input terminals 42B as shown in FIG. 4 that are soldered to an a-c power cord 50A.

The non-magnetic, outer coil casing 43 encircles a magnetic conductive coil casing 45 that encloses the coil as shown in FIGS. 1 and 4, and is attached thereto by an attachment means. The casing 43 has an opening 43B that is positioned to allow the pair of coil input terminals 42B to project therethrough. The handle 44 has a forward section 44A that attaches, by an attachment means, to the outer coil casing 43. Included within the handle is a power circuit housing 44C and a trigger pivot housing 44D. The housing 44D houses a trigger structure 46 that includes a lower mechanical finger trigger 46A and an upper head spray lever 46B that pivots about a trigger pivot 46C and that interfaces with the upper surface 20A of the spray head 20.

The movable-armature activator 40 is releasably attached to the paint spray can 12 by an attachment means 48. One implementation of this attachment means consists of having at least one spring latch 48A having an upper end 48B that is rigidly attached to the bottom of the forward section 44A of the handle 44 and a lower end 48C having a gripping hook 48D that attaches to the attachment ring 12F on the spray can 12.

Figure 5:
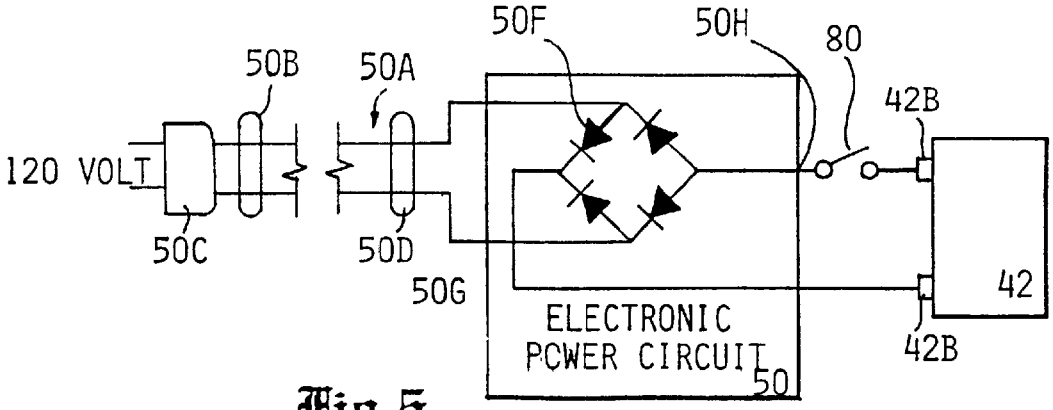
FIG. 5 is a schematic diagram of the electronic power circuit. The circuit includes an alternate switch that is used in a second embodiment.

The electronic power circuit 50 as shown schematically in FIG. 5, is located within the power circuit housing 44C in the handle 44 as shown in FIG. 1. The circuit is comprised of an a-c power cord 50A having a first end 50B that has attached an a-c power connector 50C that connects to a utility power receptacle and a second end 50D that is attached to the input of a full-wave rectifier 50F. The output of the full-wave rectifier is a pulsating d-c current that is applied to the coil 42 via the input terminals 42B of the electromagnetic coil 42. The use of the a-c utility power precludes the use of low-voltage batteries to operate the solenoid assembly 22.

When the linear-motion solenoid assembly 22 is not energized by the movable-armature activator 40, the paint pressure and the spring 26, located in said stationary armature, maintain the movable armature 28 in the de-energized, upward position. In the upward position, the valve leaf 30 and the paint passage sealing means function in combination as a closed valve that is in series with the spray control valve 18. The closed combination valve prevents the spray control valve 18 from receiving paint and prevents the spray head 20 from dispensing paint. Conversely, when the movable-armature activator 40 is connected to an a-c power receptacle, a d-c current is produced by said full-wave rectifier 50F. This current energizes the electromagnetic coil 42 which then causes the movable armature 28 to overcome the paint pressure and spring bias and move to the energized, downward position. In the downward position the combination valve opens to allow the spray control valve 18 to be activated when the spray head 20 is depressed. This action allows pressurized paint to flow through said paint passage bore and out of the spray head 20.

Figure 12:
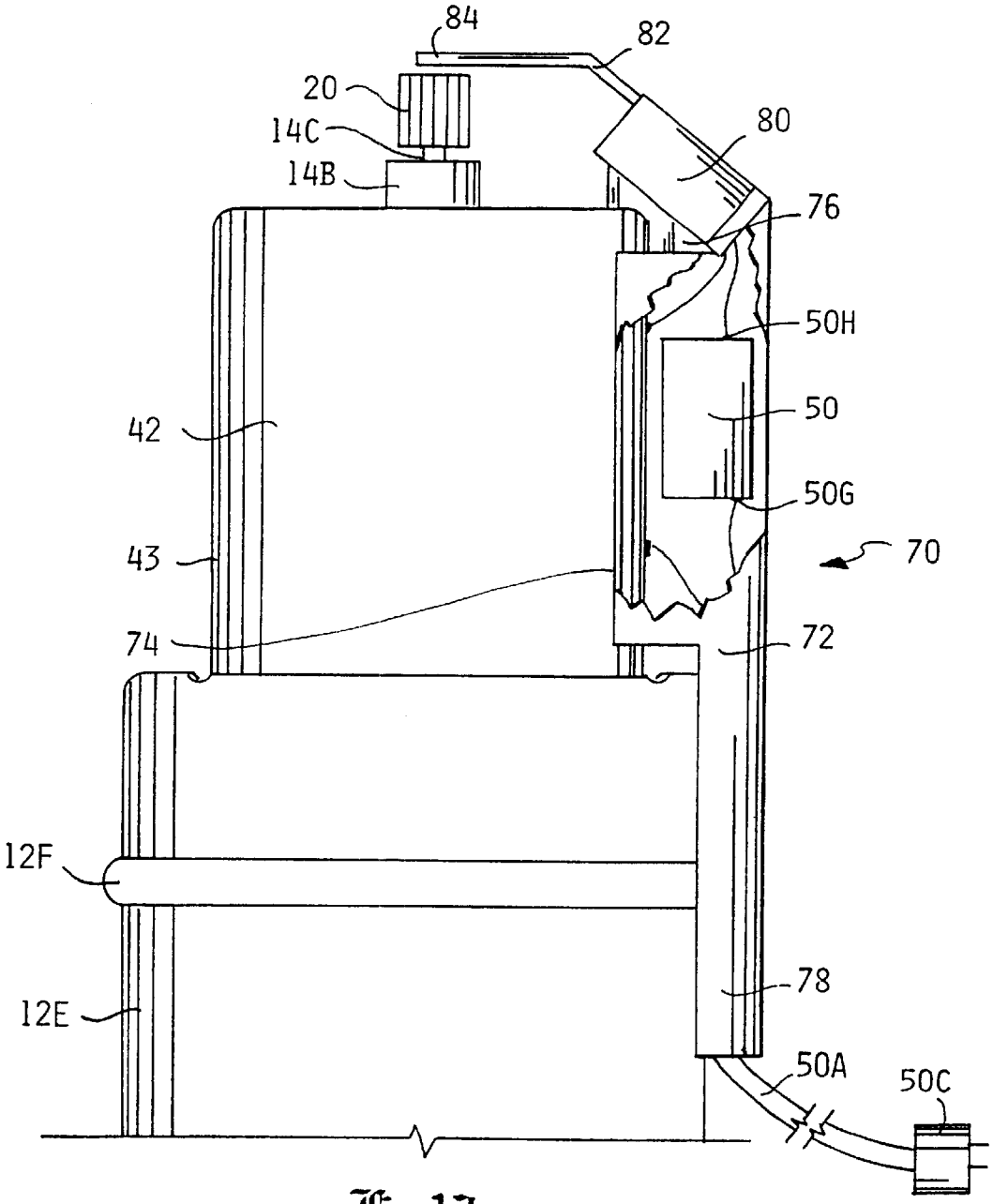
FIG. 12 is an elevational, sectional view of a first embodiment that utilizes a flush mounted energizing assembly that does not include a handle.

In lieu of the handle 44 and trigger structure 46 as shown in FIG. 1, an energizing assembly 70 as shown in FIG. 12 can be employed. The assembly 70 includes a housing 72 having an inward side 74, an upper side 76 and a lower side 78. An upper section of the inward side 74 is configured to be attached, by an attachment means such as an adhesive, to one side of the outer coil casing 43. To the upper side 76 of the housing 72, is attached a power switch 80 by an attachment means. From the lower end of the switch 80 extends an a-c power cord 50A; and from the switch upper end extends a switching lever 82. The switching lever has an outer section 84 that extends over the top of the spray head 20 as shown in FIG. 12. The switching lever 82 is positioned so that a slight downward pressure closes the switch 80 and depresses the spray head.

The electronic power circuit 50 as shown in FIG. 5, is located within the housing 72 and has an a-c input 50G and a d-c output 50H. The input is connected to one side of an a-c power cord 50A which terminates with an a-c power connector 50C that is connected to an a-c power receptacle. The output 50H is connected through the switch 80 to the electromagnetic coil 42. When the lever 82 is depressed and the switch 80 is activated, power is applied to the electromagnetic coil 42. The circuit 50 also includes a heat sensor 50I that turns off the d-c output 50H when a preset temperature level is sensed.

The design of the first embodiment of the utility-power operated, pressurized spray can 10 allows the invention to be attached to a standard unmodified pressurized spray can 12. This design differs in structure only from the first design embodiment in the configuration of the solenoid housing 14 and the paint guide tube 32.

Figure 11:
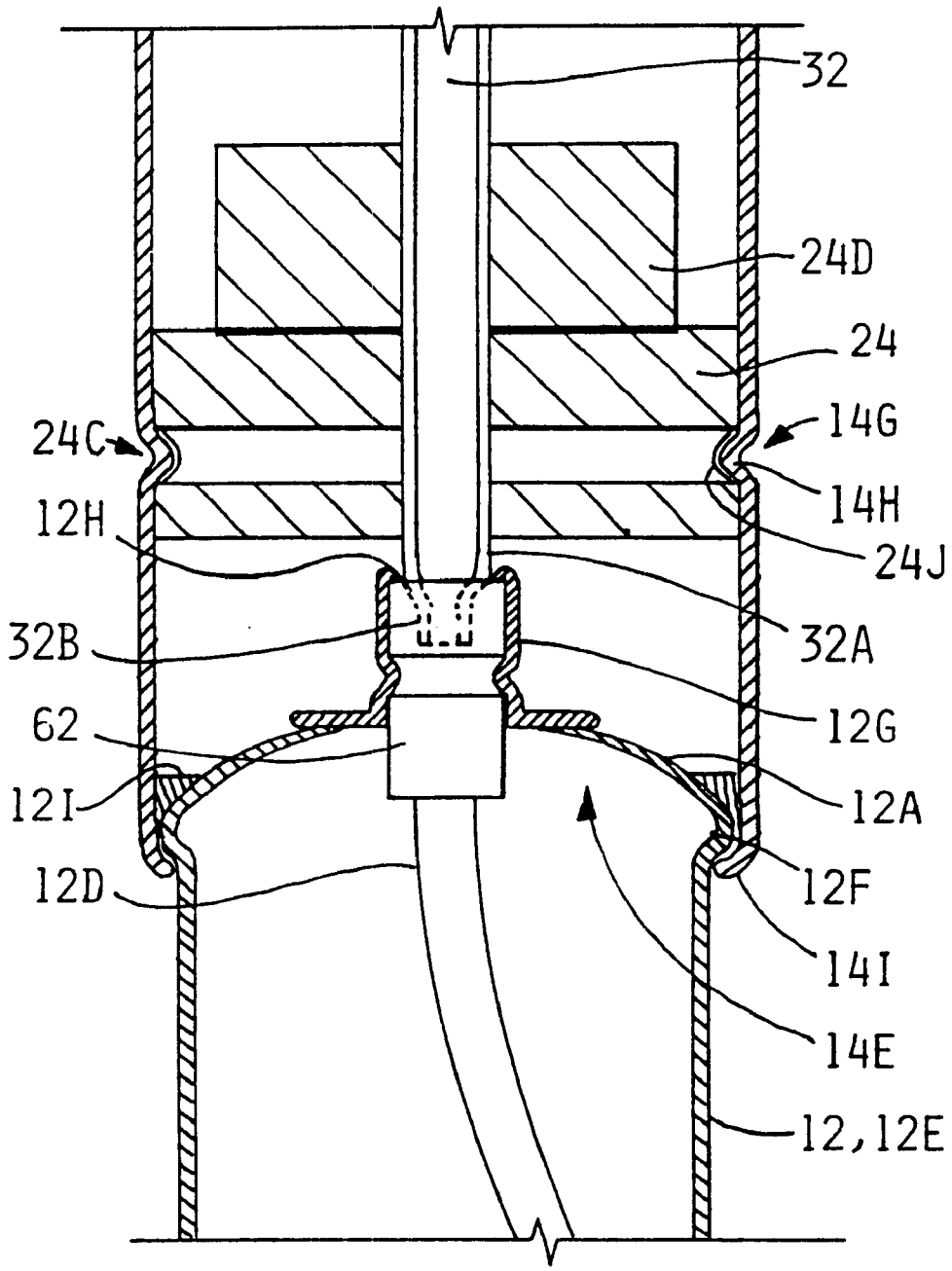
FIG. 11 is a partial, elevational, sectional view of the second embodiment which allows the inventive elements to be attached to a standard unmodified spray can.

As shown in FIG. 11, the standard pressurized spray can 12 includes an upper section 12A having a protuberance 12G that has a spray head insertion opening 12H. The opening 12H interfaces with the upper end of a conventional spray control valve 62 located within the protuberance 12G. The valve has a lower end that normally attaches to the upper end of a paint siphon tube 12D uprightly located therein. The upper section 12A of the can is attached to the can's lower section 12E by an attachment ring 12F.

The solenoid housing 14, which is preferably made of a non-magnetic material differs from the first embodiment in the configuration of its open bottom section 14E. This section has at its perimeter edge, an attachment seam 14I that is sized to forceably interface with the attachment ring 12F on the spray can 12. To further attach the housing 14 to the spray can 12, a heat flow adhesive 12I ring may be placed around the interface joint.

The third and final differing element used in the second design of the first embodiment is the non-magnetic paint guide tube 32. This tube differs in that its lower section 32A has a lower end 32B that is necked-down to a size that can be inserted into the spray-head insertion opening 12H on the spray can as shown in FIG. 11. The remainder of the elements used in the second embodiment are identical to those of the first design and perform similar functions.

The second embodiment of the utility-power operated, pressurized spray can 10 is presented in FIGS. 3–5, 9, 10 and 13–30, and is comprised of the following major elements: a pressurized spray can 12; a non-magnetic valve housing 15, a movable ferro-magnetic armature 19, a valve assembly 16 consisting of a stationary valve section 16A and a movable valve section 16B; a spring 26, and an external, separable movable-armature activator 51.

Figure 13:
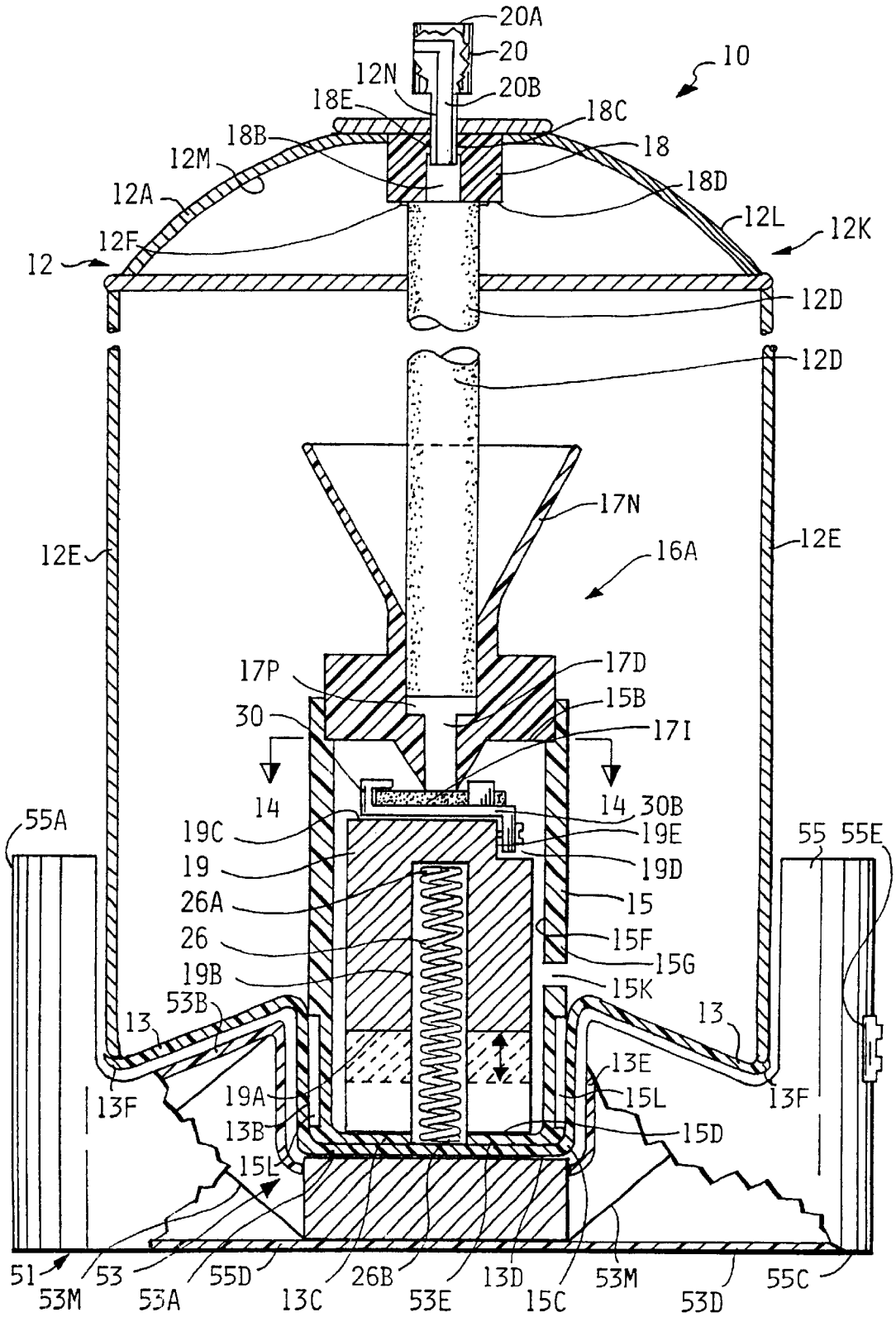
FIG. 13 is a an elevational, sectional view of a first design of the second embodiment of the utility-power operated pressurized spray can. The figure shows the relative placement of the principle elements of the invention including a movable ferro-magnetic armature that moves longitudinally.

The pressurized spray can 12 used in the second embodiment utilizes as shown in FIG. 13, an unmodified upper can cover 12K having an upper surface 12L, a lower surface 12M and a centered spray head opening 12N therethrough. Attached to the lower surface 12M of the cover, is a standard spray control valve 18. The valve has an upper end 18C, and a lower end 18D. The upper end includes a spray head stem opening 18E and a lower end 18D. Between the opening 18E and the lower end there is located a paint passage channel 18B. The spray control valve 18 operates with a standard spray head 20 having an upper surface 20A and a downward, hollow stem 20B. The stem is inserted into the spray head stem opening 18E. When the upper surface 20A of the spray head is pressed, the control valve 18 opens. To the lower end 18D of the valve 18 is attached an upper end 12P of a siphon tube 12D that has a lower end 12Q that hangs free.

The can incorporates a non-magnetic lower can cover 13 having an exterior concave shape 13A further having: a substantially centered, downward extending valve cavity 13B. The cavity has an inner lower surface 13C, an outer lower surface 13D and cylindrical inner side walls 13E. The length of the valve cavity 13D of the cavity is on the same horizontal plane as the lower edges 13F of the concave shaped can cover 13. Thus, the can 12 is stable when it is placed on a flat surface.

Figure 14:
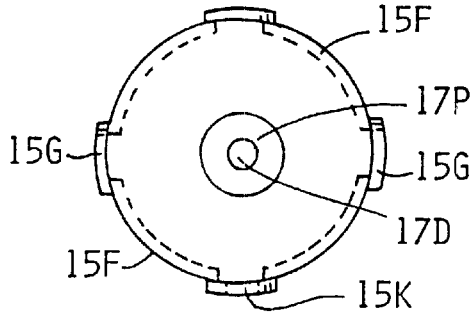
FIG. 14 is a plan view of the invention taken along the lines 14—14 of FIG. 13.
Figure 15:
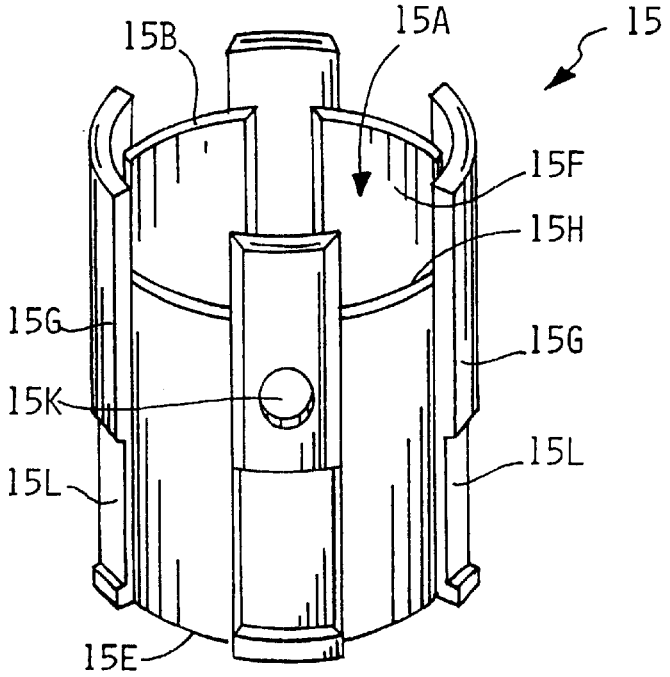
FIG. 15 is a perspective view of the non-magnetic valve housing.
Figure 16:
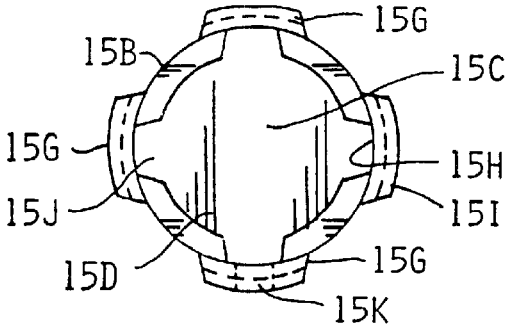
FIG. 16 is a top view of the valve housing.

The non-magnetic valve housing 15 is shown attached in FIGS. 13 and 14 and separated in FIGS. 15 and 16. The housing includes an open upper end 15A as best shown in FIG. 15 that has a perimeter inward step 15B. The housing has a closed lower end 15C having an inner surface 15D and an outer surface 15E. The outer surface 15E as shown in FIG. 13 interfaces with the inner lower surface 13C of the valve cavity 13B. The housing has side walls 15F that integrally extend and enclose the valve housing 15 from the open upper end 15A to the closed lower end 15C. The side wall exterior has at least three but preferably four longitudinally located stabilizing protrusions 15G that extend outward as beat shown in FIG. 16. The protrusions 15G each have inner walls 15H and outer walls 15I as best shown in FIG. 16. The outer wall 15I of each protrusion frictionally interfaces with the cylindrical walls 13E of the valve cavity 13B. The inner walls 15H of the protrusions form an outward wall of a longitudinal paint passage channel 15J. The final element described for the valve housing is a paint passage bore 15K that extends laterally through at least one of the stabilizing protrusions and is located above the valve cavity 13B.

Figure 19:
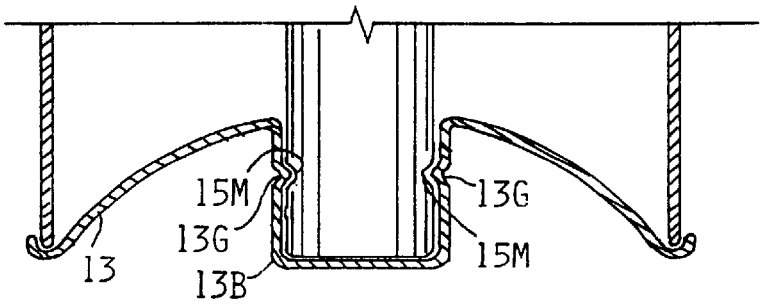
FIG. 19 is a partial side elevational view showing a valve cavity into which is inserted a valve housing that is retained therein by a plurality of detent crimps.

As shown in FIG. 19, the valve cavity 13B can be made to include a plurality of male detents 13G that extend inward around the cavity perimeter. The valve housing 15 then would include a like plurality of aligned female detents 15M. The detent pairs allow the valve housing 15 to remain securely locked when inserted into the valve cavity 13B.

The movable, ferro-magnetic armature 19 as also shown in FIG. 13 has a diameter that allows it to traverse longitudinally through the valve housing 15. The armature 19 consists of a lower surface 19A having a substantially centered spring cavity 19B; and a top surface 19C having on one side a valve leaf attachment step 19D. The step is located in chord relationship and has a vertical side 19E.

The movable armature is designed to operate a valve assembly 16 consisting of a stationary section 16A and a movable section 30.

Figure 17:
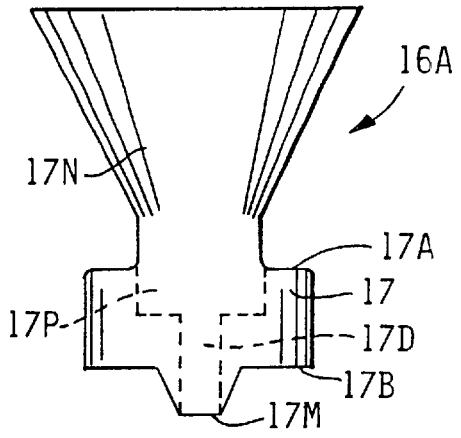
FIG. 17 is a side elevational view of the stationary section of the valve assembly.
Figure 18:
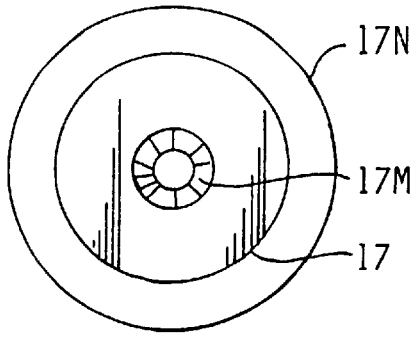
FIG. 18 is a top view of the stationary section of the valve assembly.

The stationary section 16A is shown functionally attached in FIG. 13 and as a separate element in FIGS. 17 and 18. The stationary section consists of a mid section having an upper surface 17A and a lower surface 17B. The mid section has an outer dimension that is sized to frictionally fit into and rest upon the perimeter's inward step 15B located on the perimeter of the upper end of the valve housing 15. From the lower surface 17B of the mid section, integrally tapers downward, a valve port 17M having a paint passage bore 17D that extends upward and terminates substantially mid way into the mid section as best shown in FIG. 17. From the upper surface 17A of the mid section is an upwardly extending funnel shaped section 17N having a smaller diameter that is integrally attached to the upper surface 17A of the mid section. Extending downward from the smaller diameter of the funnel section 17N is a substantially centered siphon tube cavity 17P that extends downward from the smaller diameter of the funnel section. The cavity 17P terminates at the intersection of the paint passage bore 17D and is dimensioned to allow the lower end of the siphon tube 12D to securely fit therein as shown in FIG. 13.

The second element of the valve assembly is the movable section 16B which is presented in two designs. The first and preferred design consist of a non-magnetic valve leaf 30 as shown attached in FIGS. 3 and 13. The valve leaf 30 is configured in an L-shape with a vertical section 30A and a horizontal section 30B. The horizontal section has an upper surface 30C and a lower surface 30D. To the upper surface is attached, by an attachment means, a compliant pad 17I. The attachment means can consist of an adhesive 30K as shown in FIG. 7, or a plurality of tabs 30J as shown in FIG. 9. The vertical section 30A is loosely coupled, by an attachment means, to the vertical side 19E of the valve leaf attachment step 19D. The loose coupling permits the horizontal section 30B to be movably positioned in either a closed valve position, or in an angular open valve position. When the valve leaf 30 is in the closed valve position, an upper surface of the compliant pad 17I is pressed against the valve port 17M. Conversely, when in the valve open position, the upper surface of the compliant pad 17I is released from the valve port 17M.

The movable section 16B is normally maintained in a closed position by the movable armature 19 which is spring biased in an upward position as shown in FIG. 13. The spring 26 has an upper end 26A and a lower end 26B. The lower end 26B rests on the inner surface 15D of the closed lower end 15C of the valve housing and the upper end 26A is dimensioned to be captively held within the spring cavity 19B on the movable armature 19.

Figure 23:
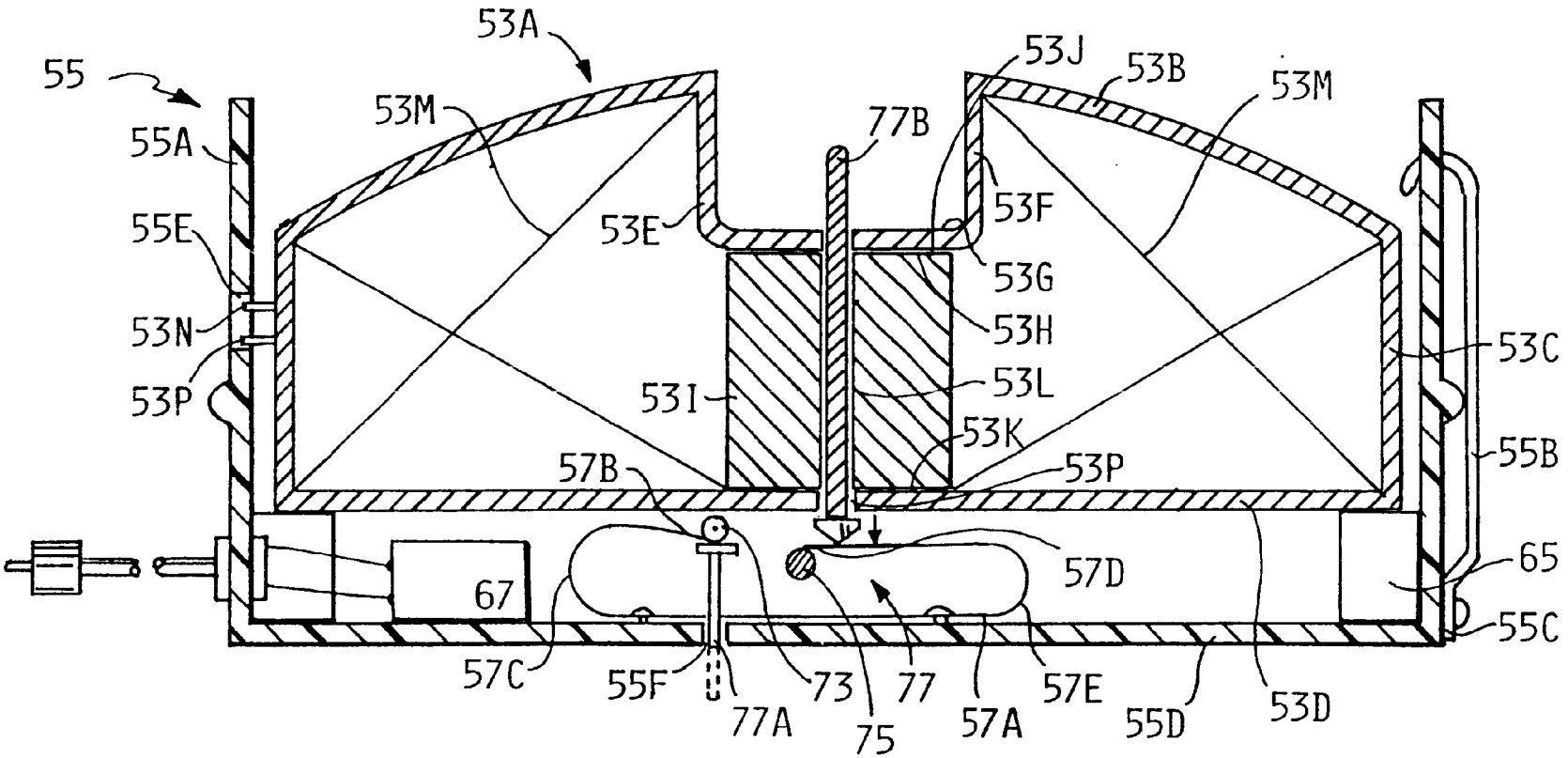
FIG. 23 is a partial elevational view of an activator that includes a lower compartment in which is housed an electro-mechanical assembly that allows electrical power to be applied only when a spray can is inserted into the activator and the activator is held above a surface.

The second embodiment of the utility-power operated, pressurized spray can 10 is designed to operate with an external, separable movable-armature activator 51 that is attached to the bottom of the spray can 12 as shown in FIGS. 13 and 23. The activator 51 is comprised of an electromagnetic section 53 and a non-magnetic cupped structure 55.

The electromagnetic section 53 consists of a ferro-magnetic housing 53A, a stationary ferro-magnetic armature 53I and an electromagnetic coil 53M. The ferro-magnetic housing 53A has an upper section 53B, side walls 53C and a lower cover 53D. The upper section includes a downward extending cavity 53E having a lower section 53F with an upper surface 53G and a lower surface 53H. The upper section 53B substantially conforms to the concave shape of the non-magnetic lower can cover 13.

The stationary ferro-magnetic armature 53I has an upper surface 53J that interfaces with the lower surface of the centered valve cavity 13B and a lower surface 53K that interfaces with the lower cover 53D of the housing 53A.

Circumferentially wound around the stationary armature 53I is the electromagnetic coil 53M. The coil is contained within the ferro-magnetic housing 53A.

The coil 53M has a first terminating lead 53N and a second terminating lead 53P that project through the housing 53A.

The non-magnetic cupped structure 55 as shown in FIG. 13, is sized to fit over the ferro-magnetic housing 53A. The structure 55 has side walls 55A that extend above the edge of the lower can cover 13 of the spray can 12. The cupped structure 55 is attached to the spray can 12 by an attachment means that preferably consists of a pair of pivoted latches as shown in FIG. 23 that have a lower end 55C attached to the bottom section 55D of the cupped structure 55. The structure 55 also has a side opening 55E through which extend the pair of coil terminating leads 53N,53P. To these leads is attached a first and second side respectfully of an a-c power connector 50C.

When the movable-armature activator is not connected to an a-c utility power source, the paint pressure in the spray can 12, in combination with the pressure of the spring 26 located within the spring cavity 19B on the movable armature 19, maintains the movable armature in a normal, de-energized, upward, closed position causing the compliant pad 17I on the valve leaf 30 to be placed in the closed valve position. In this position, paint cannot be sprayed when the spray head is pressed. Conversely, when the movable-armature activator 51 is connected to an a-c utility power source, the movable armature 19 is pulled down and the valve leaf 30 overcomes the paint pressure and the spring bias allowing the valve leaf to move angularly to the downward, open valve position. In this position, as shown in FIG. 13, paint will flow sequentially through the paint passage bore 15K, the longitudinal paint passage channels 15J, the paint passage bore 17D, the siphon tube cavity 17P, the siphon tube 12D and into the hollow stem 20B on the spray control valve 20 whereupon, when the spray head is depressed, paint can be sprayed.

The second design of the second embodiment differs from the first design in the construction and design of the movable armature 19 and the external, separable movable-armature energizing assembly.

Figure 21:
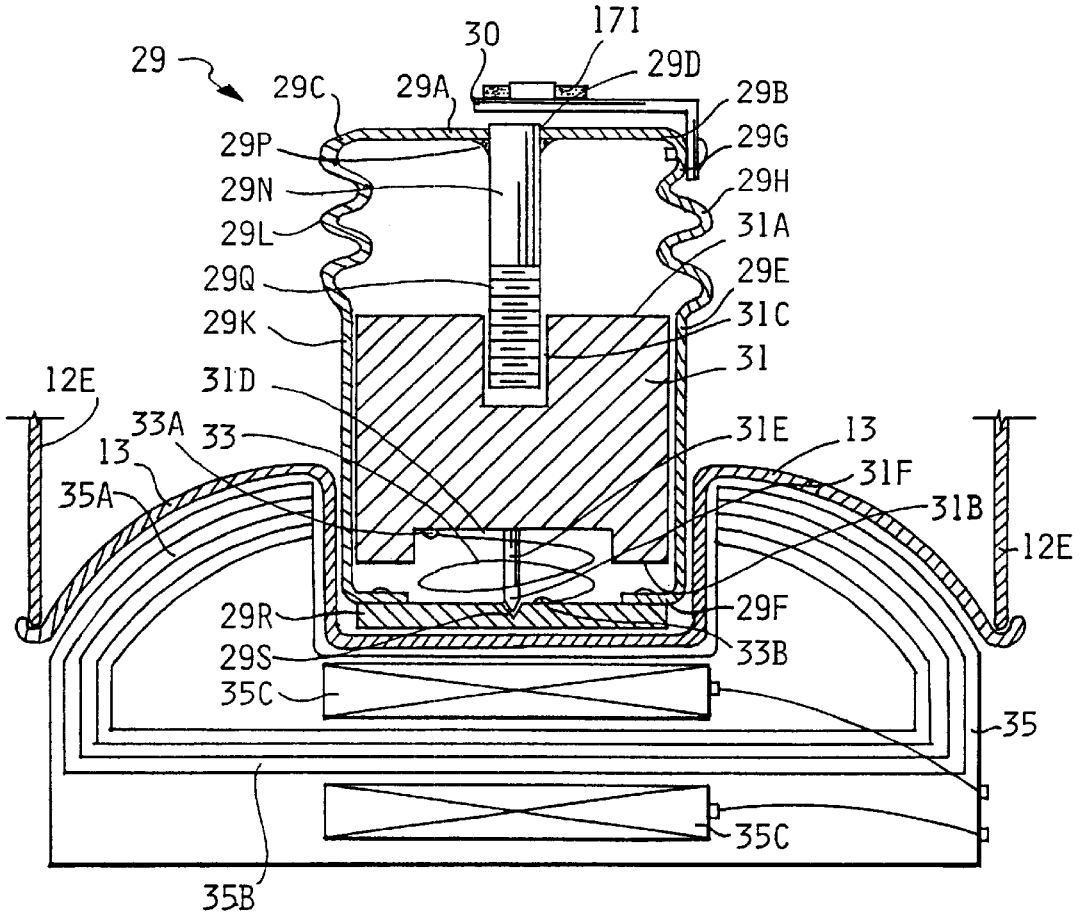
FIG. 21 is an elevational, sectional view of a second design of the second embodiment which utilizes a movable ferro-magnetic armature that rotates.

The second design of the movable armature 19 shown in FIG. 21, consists of a support 29 and an integral left section 29K, an armature drive rod 29N, a movable armature 31 and an external, separable movable-armature activator 35.

The support 29 consists of an upper section 29A having a first end 29B, a second end 29C, and a substantially centered drive rod attachment bore 29D. Extending downward from the first end is the integral right section 29E that terminates with an inward extending tab 29F. The section 29F further has near and below the upper section 29A, a valve leaf attachment bore 29G and below the attachment bore a first resilient section 29H.

The integral left section 29K extends downward from the second end 29C of the upper section and terminates with an inward extending tab 29F. The left section further has, in alignment with the first resilient section 29H, a second resilient section 29L. The left and right resilient sections 29H,29L are equally loaded to provide a compressive force.

The armature drive rod 29N has an upper end 29P and a lower threaded section 29Q. The upper end 29P extends through the drive rod bore 29D and is fixedly attached therein by an attachment means that may consists of a brazing or welding process.

The movable armature 31 has an upper surface 31A and a lower surface 31B. The upper surface has a centered drive-rod threaded cavity 41C and the lower surface 31B has a spring cavity 31D. From the center of the cavity 31D is attached a downward extending, armature pivot rod 31E that has a pointed lower end 31F. The drive-rod threaded cavity 31C is sized to be threaded into the lower threaded section 29Q of the armature drive-rod 29N.

To complete the support 29, a fixed base 29R is attached to the respective inward tabs 29F on the right and left sections by an attachment means which preferably consists of a threaded bolt. The fixed base 29R includes a centered female pivot detent 29S that is sized to rotatably accept the pointed lower end 31F of said armature pivot rod 31E.

Between the spring cavity 31D and the fixed base 29R is located a rewind spring 33. The spring has an upper end 33A attached to one corner of the armature spring cavity 31D and a lower end 33B attached near the female pivot detent 29D.

Loosely coupled, as also shown in FIG. 21, is a non-magnetic valve leaf 30 configured in an L-shape with a vertical section 30A and a horizontal section 30B. The valve leaf functions in a similar manner as described supra.

The external, separable movable-armature activator 35 is dimensioned to be inserted over and around the lower section 12E of the pressurized spray can 12 within the area encompassing the movable armature 31. The activator 35 used with the rotating movable armature 31 utilizes a laminated split-phase armature 35A as shown in FIG. 21, the armature 35A includes a horizontal section 35B around which is wound an electromagnetic coil 35C. The activator 35 has means for being connected to an a-c utility power receptacle. When the activator is not connected to the a-c power receptacle, the paint pressure in the spray can, in combination with the pressure of the rewind spring 33, maintain the movable armature 31 in an upward closed position, in which position paint cannot be sprayed when the spray head 20 is depressed, conversely, when the activator 35 is connected to the a-c utility power, the movable armature rotates allowing the movable section of the valve assembly to move downward to its open position allowing paint to flow sequentially through the paint passage bore, the open valve assembly, the paint siphon tube and into the paint passage channel in the spray control valve whereupon, when the spray head is depressed, paint can be sprayed.

Figure 20:
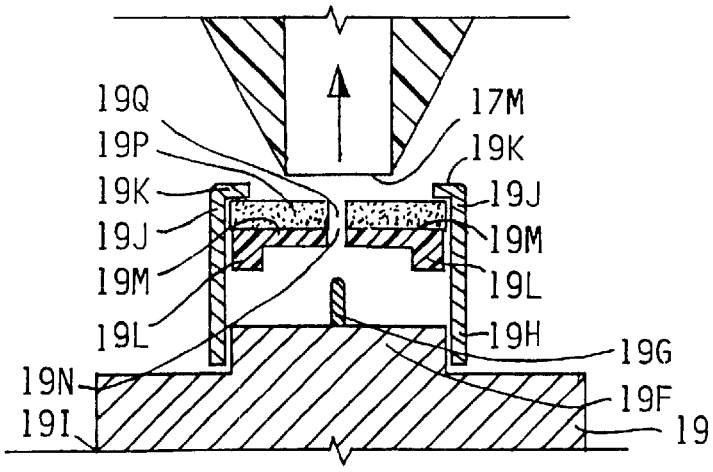
FIG. 20 is a partial side elevational view showing a valve assembly design consisting of the stationary section that interfaces with a movable section consisting of a compliant pad and a needle valve.

The valve assembly described supra is also disclosed in a second design as shown in FIG. 20. In this design, a movable armature 19 having a substantially centered upper protrusion 19F is used. Attached to the center of the upper protrusion is an upward extending needle valve 19G. This design also employs a containment structure 19H having a lower end 19I that is fixedly attached, by an attachment means such as screws, to the sides of the protrusion and an upper end 19J having an inward extending tab 19K.

Attached to the inward sides of the containment structure 19H is a compliant pad support 19L. The support has an upper surface 19M with a substantially centered needle valve bore 19N therethrough. The support 19L is dimensioned to traverse longitudinally within the containment structure 19H and that is held within the structure by the inward tabs 19K.

The first element used with this valve assembly is a compliant pad 19P having a needle valve bore 19Q therethrough that is in alignment with the needle valve bore in the compliant pad support 19L. When the movable armature 19 is in its normal, upward biased position, the compliant pad 19L and the pad support 19L are interfaced with the valve port 17M on the stationary valve assembly 17.

In this position, the needle valve 19G is inserted into the valve port. Conversely, when the movable armature 19 is energized, it moves downward causing, in sequence, the needle valve 19G to be pulled downward releasing the paint pressure which then allows the compliant pad to be pulled from the valve port 17M.

All the designs of the second embodiment may also include on the valve housing 15 an elongated cavity 15L located near the bottom of each of the stabilizing protrusions 15G as shown in FIG. 13. These cavities 15L prevent or at least minimizes the probability of someone attempting to force the armature 19 down by squeezing and pulling downward on the valve cavity 13B with a pair of pliers or the like.

Figure 22:
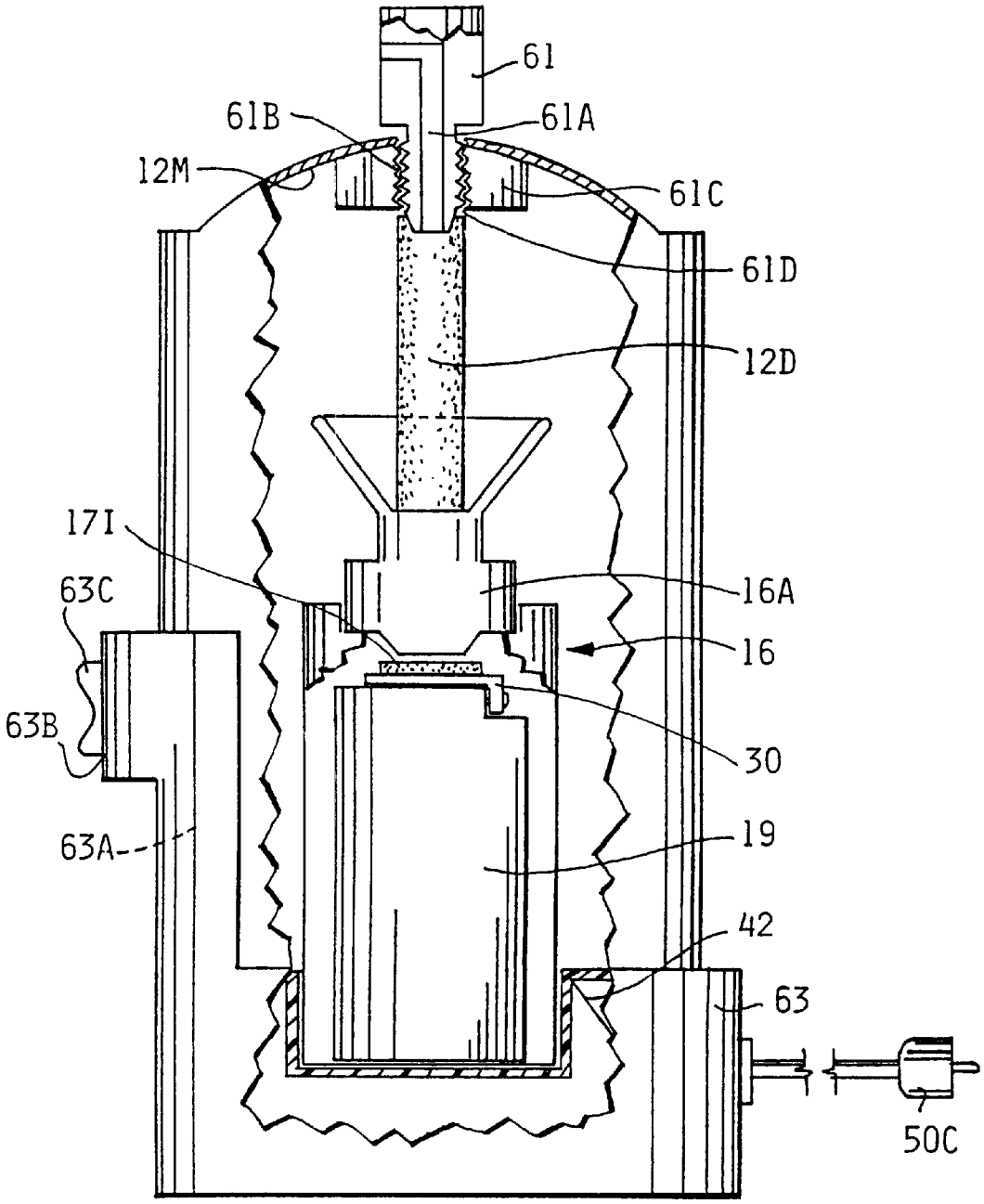
FIG. 22 is an elevational, sectional view of a second embodiment of the utility-power operated pressurized spray can that eliminates the spray control valve and uses a modified spray head that is connected directly, via a siphon tube, to the valve assembly and that utilizes a flush mounted switch to apply a-c power to the electromagnetic coil.

All of the above designs described for the second embodiment make use of a spray head 20 that is connected to an internal spray control valve 18 as shown in FIG. 13. A design that eliminates the use of the internal spray control valve 18 is shown in FIG. 22. In this design, a spray head 61 having a downward extending hallow stem 61A is removably attached by an attachment means, to a spray head stem opening 61B with the stem projecting therethrough. A siphon tube 12D having an upper end is then attached to the hallow stem opening 61B with the free standing lower end attached as described supra and as shown in FIG. 13.

The preferred means for removably attaching the spray head stem 61A to the spray head stem opening 61B is accomplished with a mounting structure 61C. The structure has a threaded bore 61D and is attached to the lower surface 12M of the upper section 12A of the spray can 12 over the spray head stem opening. In this design, a spray head 61 having a threaded hallow stem 61A is used. The threads are sized to be threaded into the threaded bore in the mounting structure.

The external, separable movable-armature activator 63 used with this design, has a housing that is dimensioned to be placed around the pressurized spray can 12 within the volume encompassing the movable armature 19. The housing 63 has therein a wiring cavity 63A having a switch opening 63B, into which is inserted an electrical switch 63C. The switch controls the application of an a-c utility power source that activates an electromagnetic coil 42 located within the housing. When the activator 63 is not connected to an a-c power source, the movable armature 19 remains in an upward closed position. Conversely, when the activator 63 is connected, the movable armature 19 moves downward, causing the valve assembly 16 to move to its downward position. The downward position allows paint to be sprayed through the spray head 61 when the electrical switch 63 is depressed.

In a second design of the activator 63, the activator has an upper section 63E that includes a lower section 63F, indicated by the broken lines in FIG. 22. The upper section which is attached to the side of the spray can 12 by an attachment means, includes on its lower section a pair of electrical male connectors (not shown). The male connectors interface with a mating pair of female connectors (also not shown) that are attached to the two ends of the coil 42 and that interface when the activator is inserted over the bottom section of the spray can 12.

The external, separable movable armature activator can be designed with a lower compartment 65 as shown in FIG. 23. Within the housing is housed an electro-mechanical assembly 67 having means for;

a) allowing the a-c utility power to be applied to the electro-mechanical coil 42 only when a spray can is inserted into the activator 51 as shown in FIG. 13 and the activator is held above a surface; and b) allowing the power applied to the activator to be turned off when a preset temperature level is sensed.

The electro-mechanical assembly 67 comprises an electronics module 69 that controls the application of the a-c utility power as shown in FIGS. 23, 28–30. The module is energized by an explosion-proof switching circuit 71, that comprises a reed witch 73 and a permanent magnet 75. The switch 73 closes only when the magnet 75 is positioned in alignment with the switch by a reed switch and magnet alignment means 77.

The reed switch and magnet alignment means 77 as shown best in FIGS. 24–27 utilizes a stationary ferromagnetic armature 53I that includes therethrough a substantially centered slide-rod bore 53L as shown in FIG. 23. Likewise, the lower compartment of the activator 51 has an upper surface 53D having a substantially centered upper slide-rod bore 53P and a lower surface 55D having a lower slide-rod bore 55F located to one side of the upper slide rod bore 53P.

Within the compartment is located a torsion-leaf spring 57. The spring has a lower horizontal section 57A that from a first end 57B, extends a first loop 57C and from a second end 57D, extends a second loop 57E. The first loop 57C has a first terminating end that is attached to the reed switch 73 and the second loop 57E has a second terminating end that is attached to the permanent magnet 75. When the horizontal section 57A is attached, by an attachment means such as a pair of screws, to the lower surface 55D of the compartment, the first terminating end is aligned with the lower slide rod bore 55F and the second terminating end is aligned with the upper slide rod bore 53P.

Figure 24:
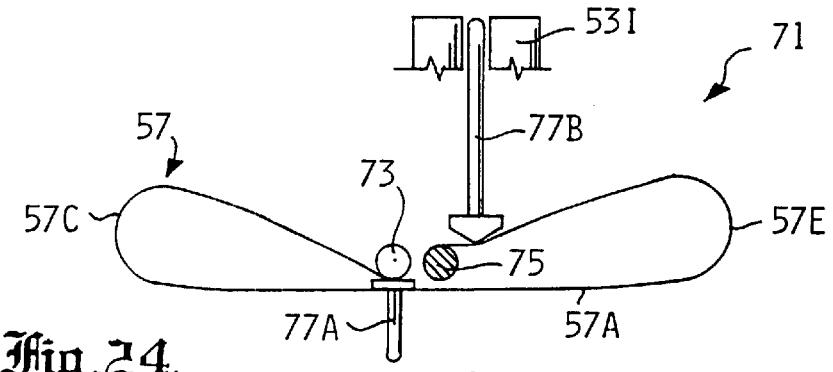
FIGS. 24–27 are schematic diagrams showing various designs for the electro-mechanical assembly which operates only when a reed switch is activated by means of an aligned permanent magnet.

The reed switch 73 and magnet aligned means further operates with a lower slide rod 77A and an upper slide rod 77B. The lower slide rod 77A is sized to slidably traverse the lower slide-rod bore 55F located on the lower surface 55D of the lower compartment. The lower slide rod bore 55F has an upper end 77C that interfaces with the first terminating end 57B of the spring. The upper slide rod 77B is sized to slidably traverse the slide-rod bore 53L on the armature 53I and the upper slide-rod bore 53P on the upper surface 53J of the lower compartment. The upper slide rod has a lower end 77D that interfaces with the second terminating end 57D of the spring. The reed switch and magnet alignment means function in the following four operating modes:

Mode 1: As shown in FIG. 24, when the spray can is inserted into an activator that is lifted from a surface, the reed switch is aligned with the magnet and the switch closes.

Figure 25:
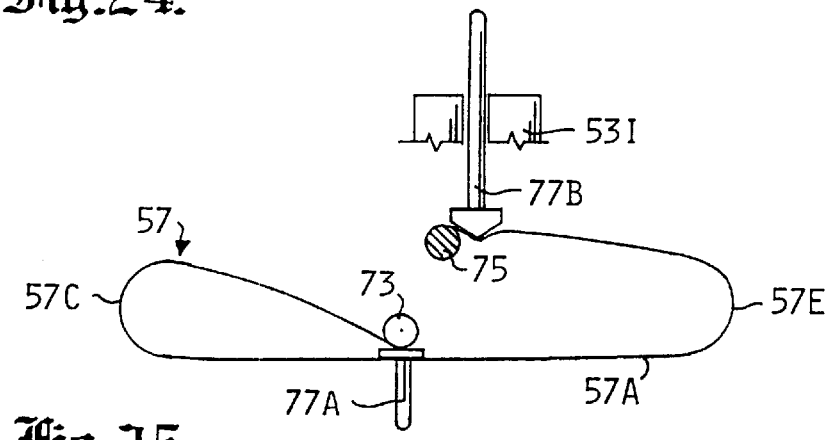

Mode 2: As shown in FIG. 25, when the spray can is not inserted into the activator that is lifted from a surface, the reed switch is not aligned with the magnet and therefore, remains open.

Figure 26:
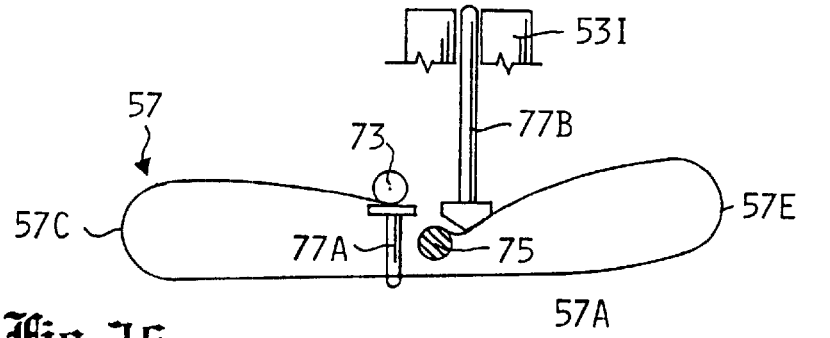
Figure 27:
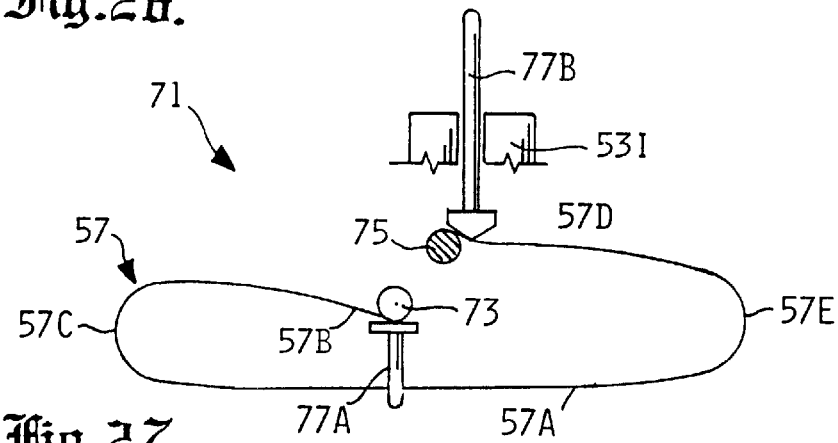
Figure 28:
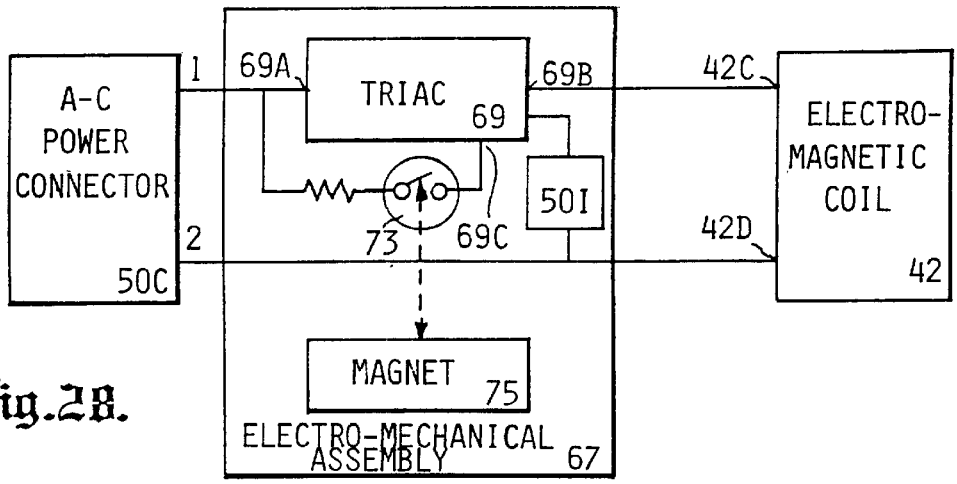
FIGS. 28–30 are block diagrams of various designs for the electro-mechanical assembly.
Figure 29:
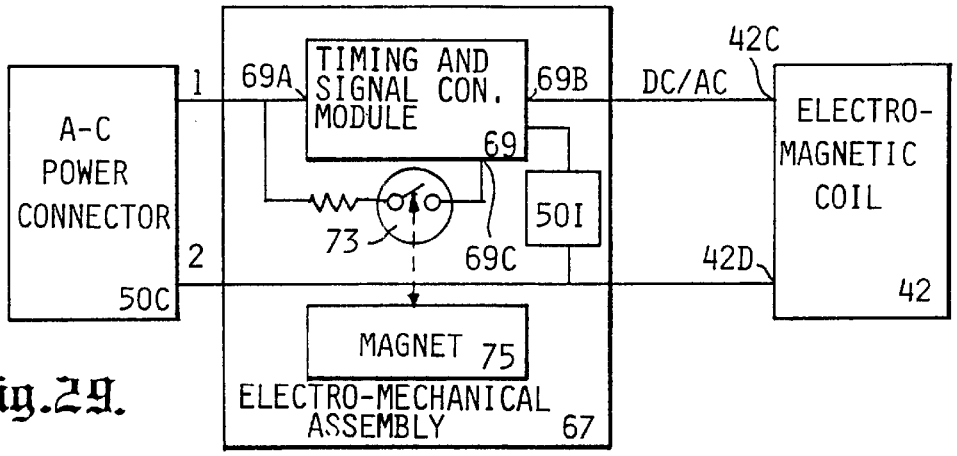
Figure 30:
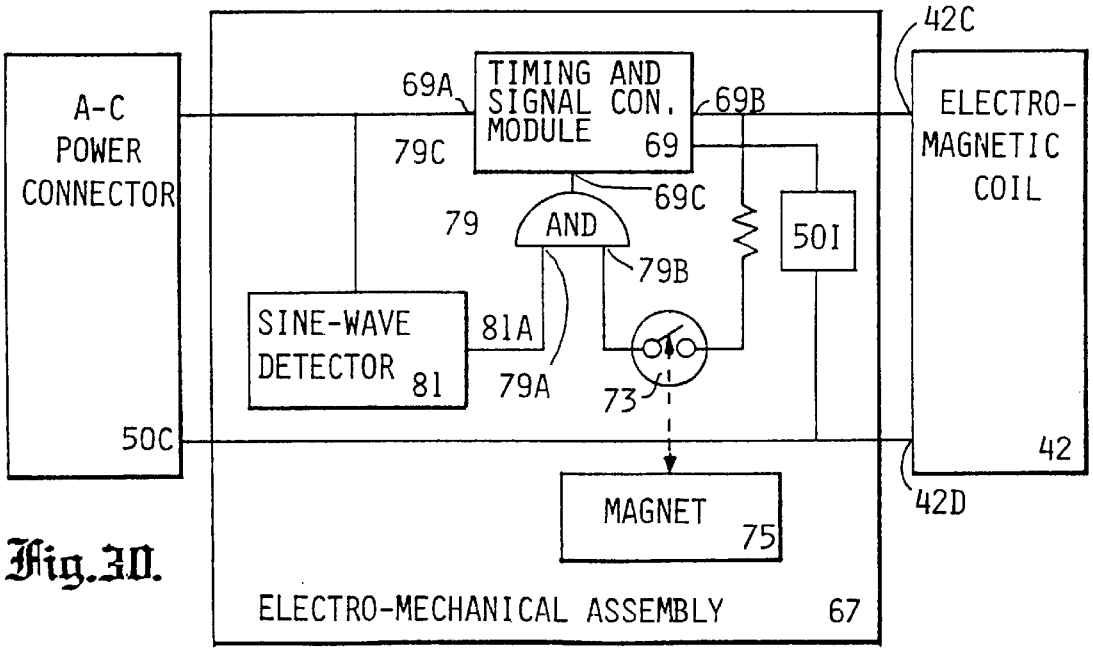

Mode 3: As shown in FIG. 26, when the spray can is inserted into an activator that is placed on a surface, the reed switch is not aligned with the magnet and therefore, remains open, and Mode 4: As shown in FIG. 27, when the spray can is not inserted into an activator that is lifted from a surface, the reed switch is not aligned with the magnet and therefore, remains open.

As can be seen from the above, the spray can, can only be operated when the reed switch and magnet alignment means is operating in Mode 1.

The reed switch and magnet alignment means functions in combination with the electronic module that is disclosed in four designs.

The first design utilizes a triac 69 having an input terminal 69A, an output terminal 69B and a gate terminal 69C. The input terminal 69A is connected to the first side of an a-c power connector 52C and the output terminal 69B connected to the first terminating lead 42C of the electromagnetic coil 42. The second side of the a-c power connector 50C is connected to the second terminating lead 42D of the coil 42. The reed switch 73 has one side connected to the triac's gate terminal 69C and the other side of the switch is connected to the triac input terminal 69A. When the reed switch 73 is aligned with the permanent magnet 75, the switch closes. The switch closure then causes the triac 69 to become enabled which then allows the a-c from the first side of the a-c power connector to be applied to the first terminating lead 42C of the coil 42.

The second design of the electronics module utilizes a timing and signal control module 69 having an input terminal 69A, an output terminal 69B and a control terminal 69C. The input terminal 69A is connected to the first side of the a-c power connector 50C and the output terminal 69B is connected to the first terminating lead 42C of the electromagnetic coil 42. The second side of the a-c power connector 42 is connected to the second terminating end 42D of the coil. The reed switch 73 has one side connected to the control terminal 69C of the module 69 and the other side of the switch is connected to the input terminal 69A of the module 69. When the reed switch 73 is aligned with the permanent magnet 75, the switch closes. The switch closure then allows the module 69 to initially produce a timed d-c output pulse which is applied to the first terminating lead 42C of the coil 42. When a preset time has lapsed, the module 69 sequentially produces an output consisting of the a-c power from the first side of the a-c power connector which is applied to the first terminating lead 42C of the coil 42.

The third and final design disclosed for the electronics module utilizes a timing and signal control module 69 having an input terminal 69A, an output terminal 69B and a control terminal 69C. The input terminal is connected to the first side of the a-c power connector 50C and the output terminal 69C is connected to the first terminating lead 42C of the electromagnetic coil 42. The second side of the a-c power connector is connected to the second terminating lead 42D of the coil 42. The module operates with an AND gate 79 and a sine wave detector 81. The AND gate has a first input 79A, a second input 79B and an output 79C. The output is connected to the control terminal 69C of the module. The sine wave detector 81 is connected across the first and second sides of the a-c power connector 50C and has an output 81A that is connected to the first input 79A of the AND gate 79.

The reed switch 73 has one side connected to the second input 79B of the AND gate 79 and the other side of the switch connected to the output terminal 69B of the module 69. When the reed switch 73 is aligned with the permanent magnet 75, the switch closes. The switch closure then allows the AND gate to become enabled if the sine wave detector is detecting a sine wave. The enabled AND gate produces an output signal that allows the module 69 to initially produce a timed d-c output pulse which is applied to the first terminating lead 42G of the coil 42. When a preset time has lapsed, the module sequentially produces an output consisting of the a-c power from the first side of the a-c power connector 50C which is applied to the first terminating lead 42C of the coil 42.

In all of the above electro-mechanical assemblies 69 is located a temperature sensor 50I. The sensor turns off the electrical power to the electromagnetic coil 42 if a preset temperature is exceeded.

While the invention as been described in complete detail and pictorially shown in the accompanying drawings, it is not to be limited to such details, since many changes and modifications may be made in the invention without departing from the spirit and scope thereof. For example, in lieu of a handle 44, the coil terminals 42B can be connected directly to an a-c power cord 50A. In this design, a user would place the hand around the casing 43 and conventionally depress the spray head 20 with the thumb. Hence, it is described to cover any and all modifications and forms which may come within the language and scope of the appended claims.

What is claimed is:

1. A spray can with an activation base for selectively interrupting and/or controlling the dispensing of can contents comprising:

an activation base having an electromagnet operated by electric current and a recess for receiving the spray can; and where, said spray can has a liquid delivery tube for conducting liquid to be dispensed to an outlet; and further where, said spray can has a bottom member, said bottom member being made of a suitable non-magnetic material, said spray can having an interruption means for selectively impeding liquid flow through said liquid delivery tube of said spray can.

2. The device of claim 1 further where said liquid flow interruption means comprises a valve disposed inside said spray can and which said valve moves between an open position and a closed position.

3. The device of claim 1 wherein the electric current is conventional household current.

4. The device of claim 3 where the conventional household current is 110 volt 60 cycle alternating current.

5. The device of claim 3 where the conventional household current is 220 volts current.

6. A utility-power operated, tamper-proof pressurized spray can comprising:

A. a pressurized spray can comprising:
  a) an upper section having a housing opening that includes around its circumferential perimeter a first attachment seam,
  b) a siphon tube uprightly located therein, B. a non-magnetic solenoid housing
  a) a top section that includes an open protuberance having an interior and a spray head stem opening,
  b) an open bottom section having at its perimeter edge a second attachment seam designed to interface with the first attachment seam on said can, C. a spray control valve retaining structure having an upper surface and a lower surface, and a valve retaining cavity recessed into the upper surface of the structure and mating with the interior of the upper protuberance and further having a paint passage bore coaxial with and below the cavity recess in said spray control valve retaining structure, D. a paint passage sealing means located on the lower surface of said valve retaining structure around the paint passage bore, E. a spray control valve crimped into said upper protuberance, and further inserted and held within the valve retaining cavity on said spray control valve retaining structure, F. a separable spray head having an upper surface and a downward, hollow stem that is inserted into said spray control valve, G. a linear-motion solenoid assembly located within said non-magnetic housing and having:
  a) a stationary armature comprising:
    (1) a lower section that is positioned and rigidly attached near the lower perimeter edge of said housing by an attachment means,
    (2) an integral upper section having a top surface and a smaller diameter that allows a space to exist between the upper section and said solenoid housing,
    (3) a spring cavity extending downward from the top surface of said upper section into which is inserted a spring,
    (4) a lower guide tube bore that extends through the bottom of the spring cavity and through the lower section of said stationary armature,
  b) a movable armature located above said stationary armature and having:
    (1) a top surface, and a bottom surface,
    (2) a diameter substantially equal to the diameter of the upper section of said stationary armature,
    (3) an upper guide tube bore therethrough having a slightly larger diameter than that of the lower guide tube bore,
  c) a non-magnetic paint guide tube comprising:
    (1) a lower section that is press-fitted into the lower guide tube bore on said stationary armature, with the lower section having an end that projects through said stationary armature and is inserted into the siphon tube located within said spray can,
    (2) an upper section that projects upward from the top surface of said stationary armature and into the slightly larger diameter upper guide tube bore on said movable armature, where said paint guide tube also functions as a positioning guide for said movable armature, and
  d) an external, separable movable-armature activator comprised of an electromagnetic coil having a center attachment opening sized to fit over the diameter of said solenoid housing, where when said activator is not connected to an a-c utility power receptacle, paint pressure and said spring, located in said stationary armature, maintains said movable armature in the de-energized, upward position that prevents said spray control valve from receiving paint and preventing said spray head from dispensing paint, conversely, when said linear-motion solenoid assembly is connected to the a-c utility power said movable armature overcomes the spring bias and paint pressure and moves to the energized, downward position in which position paint flows to said spray control valve and said spray control valve can be activated by manually depressing said spray head to allow pressurized paint to flow out of said spray head wherein said activator further comprises an electronic power circuit consisting of a full-wave bridge rectifier circuit having an input that is connected via an a-c power cord to an a-c utility power source and an output that supplies a pulsating d-c current that operates activator which then causes said movable armature to move to its energized, downward open position, said circuit also having a heat sensor that turns off the d-c output when a preset temperature level is sensed.

7. A utility-power operated, pressurized spray can comprising:

A. a pressurized spray can comprising:

a) an upper section having a housing opening that includes around its circumferential perimeter a first attachment seam, b) a lower section that attaches to the upper section by means of an attachment ring, c) a liquid siphon tube uprightly located therein, B. a non-magnetic solenoid housing comprising:

a) a top section that includes an upper protuberance having a spray head stem opening, b) an open bottom section having at its perimeter edge a second attachment seam designed to interface with the first attachment seam on said can, C. a spray control valve retaining structure having:

a) an upper surface and a lower surface, b) a valve retaining cavity recessed into the upper surface and that is centrally located under the upper protuberance, with the cavity having a substantially centered paint passage bore extending from the bottom of the cavity recess to the bottom of said spray control valve retaining structure, D. a paint passage sealing means located on the lower surface of said valve retaining structure around the paint passage bore, E. a spray control valve held within the upper protuberance by a valve crimp and further inserted into the valve retaining cavity and held therein by an attachment means, said valve having a paint passage channel that interfaces with the paint passage bore on said valve retaining structure, F. a separable spray head having an upper surface and a downward, hollow stem that is inserted into said spray control valve, G. a linear-motion solenoid assembly comprising:

a) a stationary armature having:

(1) a lower section having a bottom surface and a diameter that allows said stationary armature to tightly fit into said solenoid housing with the bottom surface positioned near the lower perimeter edge of said housing, (2) an attachment means for rigidly attaching said stationary armature to said solenoid housing, (3) an integral upper section having a top surface and a smaller diameter than that of the lower section, where the smaller diameter allows a space to exit between the upper section and said solenoid housing that magnetically decouples said movable armature to prevent the use of an external magnet to energize said solenoid assembly, (4) a spring cavity substantially centered and extending downward from the top surface of said upper section, (5) a spring inserted into said spring cavity, (6) a lower guide tube bore that extends through the bottom of the spring cavity and through the lower section of said stationary armature, (7) a paint flow channel that extends horizontally across the upper surface of said stationary armature from one side of the spring cavity to the edge of said stationary armature, b) a movable armature having:

(1) a top surface and a bottom surface, (2) a diameter substantially equal to the smaller diameter of the upper section of said stationary armature, (3) an upper guide tube bore therethrough having a slightly larger diameter than that of the lower guide tube bore on said stationary armature, (4) a valve leaf attachment step located in chord relationship on one side of said movable armature, and having a vertical side, and (5) a non-magnetic valve leaf configured in an L-shape with a vertical section and a horizontal section, where the vertical section is loosely coupled, by an attachment means, to the vertical side of the valve leaf attachment step and the horizontal section is movably positioned, in either an open position or a closed position, between the valve sealing means on the lower surface of said valve retaining structure and the top surface of said movable armature, where said movable armature is designed to be maintained in a normal, de-energized, upward position by said spring and paint pressure in which position, the top surface of said movable armature makes contact with said valve leaf, placing said valve leaf in its closed position, or in an energized, downward position in which position, the bottom surface of said movable armature makes contact with the top surface of said stationary armature, causing said leaf spring to move to its open position to allow paint to flow through the paint passage bore, c) a non-magnetic paint guide tube comprising;

(1) a lower section that is press-fitted into the lower guide tube bore on said stationary armature, with the lower section having a lower end that projects through the bottom surface of said stationary armature and is inserted into the siphon tube located within said spray can, the lower section further having, within a distance confined by the length of the spring cavity, a paint passage opening that allows a paint flow to exit and flow through the paint flow channel on said stationary armature, (2) an upper section that projects upward from the top surface of said stationary armature and into the slightly larger diameter upper guide tube bore on said movable armature, where said paint guide tube also functions as a guide for said movable armature, d) an external, separable, movable-armature activator comprising:

(1) an electromagnetic coil having a center attachment opening sized to fit over the diameter of said non-magnetic solenoid housing, a length that substantially encloses the length of said housing and a pair of coil input terminals, (2) a magnetic-conducting, outer coil casing that encloses said coil and is attached thereto by an attachment means, said casing having an opening positioned to allow the pair of coil input terminals to project therethrough, (3) a handle having a forward section that attaches, by an attachment means, to said outer coil casing and that includes a power circuit housing and a trigger pivot housing that houses a trigger structure that includes a lower mechanical finger trigger and an upper head spray level that pivots about a trigger pivot and that interfaces with the upper surface of said spray head, (4) means for releasably attaching said movable-armature activator to said paint spray can, and (5) an electronic power circuit located within the power circuit housing that is comprised of an a-c power cord having a first and that has attached an a-c power connector that connects to an a-c utility power receptacle and a second end that is attached to the input of a full-wave rectifier, where the output of the full-wave rectifier is connected to the coil input terminals of said electromagnetic coil, where the use of the a-c utility power precludes the use of low-voltage batteries to operate said linear-motion solenoid assembly where when said linear-motion solenoid assembly is not energized by said movable-armature activator, the paint pressure and said spring, located in said stationary armature, maintain said movable armature in the de-energized, upward position in which position, said valve leaf and said paint passage sealing means function in combination as a closed valve that is in series with said spray control valve, where the closed combination valve prevents said spray control valve from receiving paint and prevents said spray head from dispensing paint, conversely, when said movable-armature activator is connected to an a-c power receptacle, a pulsating d-c current is produced by said full-wave rectifier that energizes said electromagnetic coil which then causes said movable armature to overcome the paint pressure and spring bias and move to the energized, downward position in which position the combination valve opens to allow said spray control valve to be activated when said spray head is depressed which then allows pressurized paint to flow through said paint passage bore and out of said spray head, wherein the a-c power required to operate said electromagnetic coil is applied through an energizer assembly comprising:

(a) a housing having an outward side, an inward side, an upper side and a lower side, where an upper section of the inward side is configured to be attached, by an attachment means, to one side of said outer coil casing, (b) a switch attached to the upper side of said housing, by an attachment means, said switch having a lower end from where extends at least one power input lead, an upper end from where extends a switching lever having an outer section that extends over the top of said spray head, where the switching lever is positioned so that a slight downward pressure closes said switch, and depresses said spray head, and (c) said electronic power circuit located within said housing, having and an output that is connected through said switch to said electromagnetic coil, where when said switch is activated, power is applied to said electromagnetic coil.

8. A utility-power operated pressurized spray can comprising:

a) a pressurized spray can comprising:

(1) a bottom section, (2) an upper can cover having a spray head opening therethrough that interfaces with an upper end of a integral spray control valve further having a paint passage channel and a lower end that is attached to an upper end of a paint siphon tube having a free standing lower end, (3) a non-magnetic, lower can cover having an exterior concave shape further having a substantially centered, downward extending valve cavity, b) a non-magnetic valve housing having:

(1) an open upper end, a closed lower end, and side walls that integrally extend and enclose said valve housing, (2) at least three longitudinally located, stabilizing protrusions that extend outward and have inner walls and outer walls, where the outer walls interface with the valve cavity and the inner walls form an outward wall of a longitudinal paint passage channel, c) a movable ferro-magnetic armature dimensioned to traverse longitudinally through said valve housing where said armature has a lower surface having a spring cavity and an upper surface, d) a valve assembly comprising:

(1) a stationary section dimensioned to closely fit within the open upper end of said valve housing with said stationary section having an upper surface and a lower surface from where the upper surface extends downward a paint siphon tube cavity having a funnel shape to guide the siphon tube during assembly and to allow the lower end of said siphon tube to securely fit therein, and from the lower surface extends downward a valve port having a paint flow cavity that commences at the valve port and terminates at the intersection of the paint siphon tube cavity, (2) a movable section comprising a non-magnetic valve leaf having a vertical section and a horizontal section, where the vertical section is loosely coupled by an attachment means, to one of the upper surface of said movable armature, where the coupling permits the horizontal section to be movably positioned in either a closed valve position or in an angular open valve position when in the closed valve position, the horizontal section is pressed against the valve port and conversely, when in the valve open position, the horizontal section is released from the valve port, e) a spring having a lower end that rests on the closed lower end of said valve housing and an upper end that is dimensioned to be captively held within the spring cavity on said movable armature, f) an external, separable movable-armature activator comprising:

(1) an electromagnetic section comprising a ferro-magnetic housing having a downward extending cavity and that substantially conforms to the shape of the lower can cover, where within said housing is located a centered stationary ferromagnetic armature having an upper surface that interfaces with the downward extending valve cavity and a lower surface that interfaces with a lower surface of said housing, where around said armature is circumferentially wound an electromagnetic coil having a first terminating lead and a second terminating lead that project through said housing, (2) a non-magnetic cupped structure sized to fit over said ferro-magnetic housing and having means for being attached to said spray can, with said structure having an opening through which extend the two terminating leads of said coil which are then attached to a first and second side respectively of an a-c utility power cord, where when said activator is not connected to an a-c utility power receptacle, the paint pressure in said spray can, in combination with the pressure of said spring located within the spring cavity on the movable armature, maintains said movable armature in a normal, de-energized, upward, closed position causing the horizontal section of said valve leaf to be placed in the closed valve position in which position, paint cannot be sprayed when the spray head is pressed, conversely, when said movable-armature activator is connected to an a-c utility power source, said movable armature is pulled down causing said valve leaf to overcome the paint pressure and spring bias allowing said valve leaf to move to the downward, open valve position in which position, paint will flow sequentially through the paint passage bore, the longitudinal paint passage channels, the paint flow cavity, the siphon tube cavity, the siphon tube and into the paint passage channel on the spray control valve whereupon when the spray head is depressed, paint can be sprayed.

9. A utility-power operated, pressurized spray can comprising:

a) an upper can cover having an upper surface, a lower surface and a spray head opening therethrough, b) a spray control valve having an upper end further having a spray head stem opening, a lower end and a paint passage channel that interfaces with the spray head stem opening, where said valve is attached to the lower surface of said upper can cover by an attachment means, c) a spray head having an upper surface and a downward, hollow stem that is inserted into the spray head stem opening whereupon when the upper surface of said spray head is pressed, the spray control valve opens, d) a siphon tube having an upper end that is attached to the lower end of the spray control valve and a free standing lower end, e) a non-magnetic, lower can cover having an exterior concave shape further having a substantially centered, downward extending valve cavity having an inner lower surface, an outer lower surface and cylindrical walls, where the length of the valve cavity extends downward to where the outer lower surface of the valve cavity is on the same horizontal plane as the lower edges of the concave shaped can cover, so that said spray can is stable when placed upon a flat surface, B. a support comprising:

a) an upper section having a first end, a second end, and a substantially centered drive rod attachment bore, b) an integral right section that extends downward from the first end of said upper section and terminates with an inward extending tab and further having near and below the upper section a valve leaf attachment bore and below the attachment bore a first resilient section, c) an integral left section that extends downward from the second end of said upper section and terminates with an inward extending tab and further having, in alignment with the first resilient section, a second resilient section, wherein said left and right resilient sections are equally loaded to provide a compressive force, C. an armature drive rod having an upper end and a lower threaded section, where the upper end extends through the drive rod bore and is fixedly attached therein by an attachment means, D. a movable armature having an upper surface and a lower surface, with the upper surface having a centered drive-rod threaded cavity and the lower surface having a spring cavity from where the center of the cavity is attached a downward extending, armature pivot rod having a pointed lower end, where the drive-rod threaded cavity is threaded into the lower threaded section of the armature drive rod, E. a fixed base attached to the respective inward tabs on the right and left sections by an attachment means with said fixed base having a centered, female pivot detent that is sized to rotatably accept the pointed lower end of said armature pivot rod, F. a non-magnetic valve leaf configured in an L-shape with a vertical section and a horizontal section, where the horizontal section has an upper surface and a lower surface, where to the upper surface is attached by an attachment means, a compliant pad, and the vertical section is loosely coupled, by an attachment means, to the valve leaf attachment bore located on the integral right section of said armature support, where the coupling permits the horizontal section to be movably positioned in either a closed valve position, or in an open valve position, where an upper surface of said compliant pad is pressed against the lower valve port and when in the valve open position, the upper surface of said compliant pad is released from the valve port, G. a rewind spring having an upper end attached to one corner of said armature spring cavity and a lower end attached near the pivot detent, and H. an external, separable movable-armature activator that is dimensioned to be inserted over and around the lower section of said pressurized spray can within the area encompassing said movable armature, said activator having means for being connected to an a-c utility power receptacle, where when said activator is not connected to the a-c power receptacle, the paint pressure in said spray can, in combination with the pressure of said rewind spring, maintains said movable armature in an upward position which allows the movable section of said valve assembly to remain in its upward closed position, in which position paint cannot be sprayed when the spray head is depressed, conversely, when said activator is connected to the a-c utility power, said movable armature rotates allowing said movable section of said valve assembly to move downward to its open position allowing paint to flow sequentially through the paint passage bore, the open valve assembly, the paint siphon tube and into the paint passage channel in the spray control valve whereupon, when the spray head is depressed, paint can be sprayed.

10. A utility-power operated, pressurized spray can comprising:

a) a pressurized spray can having an upper section and a bottom section, with the upper section having et spray head stem opening, b) a spray head inserted into and attached to the spray head opening by an attachment means, c) a non-magnetic valve housing located within said spray can and having a lateral paint passage bore that is open to the paint in said spray can, d) a movable ferro-magnetic armature having an upper surface and a lower surface where said armature is dimensioned to traverse longitudinally through said housing, e) a spring located between the lower surface of said movable armature and said valve housing, where said spring normally biases said movable armature in an upward position, f) a valve assembly positioned within said pressurized spray can above said movable armature, said valve assembly comprising:

(1) a stationary valve section having a paint passage bore having an upper end and a lower end, where the upper end terminates, via the paint siphon tube, with the lower end of said spray control valve, (2) a movable valve section that is attached by an attachment means, to the upper surface of said movable armature, where said movable section can be placed in either a downward open position or an upward closed position, and g) an energizer assembly comprising:

(1) a housing having an outward side, an inward side, an upper section and a lower end, with the inward side having therein a wiring cavity and configured to be attached, by an attachment means, to one side of said spray can, the upper section having a switch opening that interfaces with the wiring cavity and with the lower end having a pair of electrical conductors, having inward terminals and outward terminals, (2) an electrical switch inserted into the switch opening and electrically connected to the inward terminals of the electrical conductors, h) an external, separable movable-armature activator comprised of an electromagnetic coil that is dimensioned to be inserted over and around a downward extending valve cavity in the bottom section of said pressurized spray can, said cavity providing the volume which encompasses said movable armature, said activator having an upper section that includes a lower surface having a pair of electrical conductors that terminate at a pair of male connectors, where the male connectors interface with a pair of female connectors that are attached to the two ends of said coil and that interface when said activator is inserted over the bottom section of said spray can, said activator also having means for being connected to an a-c utility power receptacle, where when said activator is not connected to the a-c power receptacle and said switch is placed in an OFF position, the paint pressure in said spray can, in combination with the pressure of said spring, maintains said movable armature in an upward position which allows the movable section of said valve assembly to remain in its upward closed position, in which position paint cannot be sprayed conversely, when said activator is connected to the a-c utility power and said switch is placed in an ON position, said movable armature is pulled down causing said movable section of said valve assembly to move downward to its open position allowing paint to flow sequentially through the paint passage bore, the open valve assembly, the paint siphon tube and through a paint passage orifice in the spray head.

11. A utility-power operated, pressurized spray can comprising:

a) a pressurized spray can comprising:

(1) a bottom section, (2) a spray head stem opening, (3) a spray control valve having a paint passage channel with an upper end and a lower end, where the upper end terminates at the spray head stem opening, and the lower end is connected to a paint siphon tube, (4) a spray head inserted into the spray head opening, b) a non-magnetic valve housing located within said spray can and having a lateral paint passage bore that is open to the paint in said spray can, c) a movable ferro-magnetic armature having an upper surface and a lower surface where said armature is dimensioned to traverse longitudinally through said housing, d) a spring located between the lower surface of said movable armature and said valve housing, where said spring normally biases said movable armature in an upward position, e) a valve assembly positioned within said pressurized spray can above said movable armature, said valve assembly comprising:

(1) a stationary valve section having a paint passage bore having an upper end and a lower end, where the upper end terminates, via the paint siphon tube, with the lower end of said spray control valve, (2) a movable valve section that is pivotally attached by an attachment means, to the upper surface of said movable armature, where said movable section can be placed in either a downward open position or an upward closed position, and f) an external, separable movable-armature activator that is dimensioned to be inserted over and around a downward extending valve cavity in the bottom section of said pressurized spray can, said cavity providing the volume which encompasses said movable armature, said activator having means for being connected to an a-c utility power receptacle, where when said activator is not connected to the a-c power receptacle, the paint pressure in said spray can, in combination with the pressure of said spring, maintains said movable armature in an upward position which allows the movable section of said valve assembly to remain in its upward closed position, in which position paint cannot be sprayed when the spray head is depressed, conversely, when said activator is connected to the a-c utility power, said movable armature is pulled down causing said movable section of said valve assembly to move downward to its open position allowing paint to flow sequentially through the paint passage bore, the open valve assembly, the paint siphon tube and into the paint passage channel in the spray control valve whereupon, when the spray head is depressed, paint can be sprayed.

12. The utility-power operated, pressurized spray can as specified in claim 11 wherein said valve assembly comprises;

a) a movable armature having a substantially centered upper protrusion, b) an upward extending needle valve attached to the center of said upper protrusion, c) a containment structure having a lower end that is fixedly attached, by an attachment means, to the sides of said protrusion and an upper end having an inward extending tab, d) a compliant pad support having an upper surface with a substantially centered needle valve bore therethrough, where said support is dimensioned to traverse longitudinally within said structure and that is held within to said support by the inward tabs, and e) a compliant pad having a needle valve bore therethrough that is in alignment with the needle valve bore in said compliant pad support, where when said movable armature is in its normal, upward biased position, said compliant pad and pad support are interfaced with the valve port on the stationary valve assembly with said needle valve inserted into the valve port, conversely, when said movable armature is energized, it moves downward causing, in sequence, the needle valve to be pulled downward releasing the paint pressure to then allow the compliant pad to be pulled from the valve port.

13. A utility-power operated, pressurized spray can comprising:

a) a pressurized spray can having an upper section further having a lower surface and a spray head stem opening therethrough, b) a spray head having a downward extending hollow stem that is removably attached, by an attachment means, to the spray head stem opening with the stem projecting therethrough, c) a siphon tube having an upper end that is attached to the hollow stem and having a free standing lower end, d) a movable armature dimensioned to traverse longitudinally through a non-magnetic housing, with said armature being spring biased to remain in a normal upward position, e) a valve assembly means for controlling the paint flow through the free standing lower end of said siphon tube and that is movably attached, by an attachment means, to an upper surface of said movable armature, where said valve assembly is designed to be placed in either a downward open position or an upward closed position, f) an external, separable movable-armature activator having a housing that is dimensioned to be placed around said pressurized spray can within the volume encompassing said movable armature, said housing having therein a wiring cavity having a switch opening, and g) an electrical switch that is inserted and attached into said switch opening where said switch controls the application of an a-c utility power source that activates an electromagnetic coil located within said housing, where when activator is not connected, said movable armature remains in an upward position and conversely, when said activator is connected, said movable armature moves downward, causing said valve assembly to move to its downward position which then allows paint to be sprayed through said spray head when said electrical switch is depressed.

14. The utility-power operated, pressurized spray can as specified in claim 13 wherein said means for removably attaching said spray head stem to the spray head stem opening comprises:

a) a mounting structure having a threaded bore, said structure attached to the lower surface of the upper section of said spray can over the spray head stem opening, and b) a spray head having a threaded hollow stem, where said threads are sized to be threaded into the threaded bore on said mounting structure.

15. The utility-power operated, pressurized spray can as specified in claim 14 wherein said valve assembly means comprise:

a) a stationary valve section having a paint passage bore having an upper end and a lower end, where the upper end terminates, via the free standing end of said paint siphon tube, with the lower end of said spray control valve, and b) a movable valve section that is pivotally attached by an attachment means, to the upper surface of said movable armature, where said movable section can be placed in either a downward open position or an upward closed position.

16. A utility-power operated, pressurized spray can comprising:

A. a pressurized spray can comprising:

a) an upper can cover having an upper surface, a lower surface and a spray head opening therethrough, b) a spray control valve having an upper end further having a spray head stem opening, a lower end and a paint passage channel that interfaces with the spray head stem opening, where said valve is attached to the lower surface of said upper can cover by an attachment means, c) a spray head having an upper surface and a downward, hollow stem that is inserted into the spray head stem opening whereupon when the upper surface of said spray head is pressed, the spray control valve opens, d) a paint siphon tube having an upper end that is attached to the lower end of the spray control valve and a free standing lower end, e) a non-magnetic, lower can cover having an exterior concave shape further having a substantially centered, downward extending valve cavity having an inner lower surface, an outer lower surface and cylindrical walls, where the length of the valve cavity extends downward to where the outer lower surface of the valve cavity is on the same horizontal plane as the lower edges of the concave shaped can cover, so that said spray can is stable when placed upon a flat surface, B. a non-magnetic valve housing having:

a) an open upper end having a perimeter inward step, b) a closed lower end having an inner surface and an outer surface, where the outer surface interfaces with the inner lower surface of said valve cavity, c) side walls that integrally extend and enclose said valve housing from the open upper end to the closed lower end, with the exterior side wall having at least three longitudinally located, stabilizing protrusions that extend outward and each having inner walls and outer walls, where the outer wall of each said protrusion frictionally interfaces with the cylindrical walls of the valve cavity and the inner wall of the protrusions form an outward wall of a longitudinal paint passage channel, d) a paint passage bore extending laterally through at least one of the stabilizing protrusions and located above the valve cavity, C. a movable ferro-magnetic armature having a diameter that allows said movable armature to traverse longitudinally through said valve housing with said armature having:

a) a lower surface having a substantially centered spring cavity, and b) a top surface having on one side a valve leaf attachment step located in chord relationship and having a vertical side, D. a valve assembly comprising:

a) a stationary section comprising:

(1) a mid section having an upper surface, a lower surface and an outer dimension that is sized to frictionally fit into and rest upon the inward step located on the perimeter of the upper end of said valve housing, (2) a downward section that integrally extends from the lower surface of the mid section and terminates with a valve port having a paint passage bore that extends upward and terminates substantially midway into the mid section, (3) an upwardly extending funnel section with the smaller diameter of the funnel section integrally attached to the upper surface of said mid section, (4) a substantially centered siphon tube cavity that extends downward from the smaller diameter of said funnel section and terminates at the intersection of the paint flow cavity, where the siphon tube cavity is dimensioned to allow the lower end of said siphon tube to securely fit therein, and b) a movable section comprising a non-magnetic valve leaf configured in an L-shape with a vertical section and a horizontal section, where the horizontal section has an upper surface and a lower surface, where to the upper surface is attached, by an attachment means, a compliant pad, and the vertical section is loosely coupled, by an attachment means, to the vertical side of the valve leaf attachment step, where the coupling permits the horizontal section to be movably positioned in either a closed valve position, or in an angular open valve position, when in the closed valve position, an upper surface of said compliant pad is pressed against the valve port and conversely, when in the valve open position, the upper surface of said compliant pad is released from the valve port, E. a spring having a lower end that rests on the inner surface of the closed lower end of said valve housing and an upper end that is dimensioned to be captively held within the spring cavity on said movable armature, F. an external, separable movable-armature activator comprising;

a) an electromagnetic section comprising;

(1) a ferro-magnetic housing having an upper section, side walls and a lower cover, with the upper section having a downward extending cavity having a lower section with an upper surface and a lower surface, where the upper section substantially conforms to the shape of the lower can cover, (2) a stationary ferromagnetic armature having an upper surface that interfaces with the lower surface of said valve cavity and a lower surface that interfaces with the lower cover of said housing, and (3) an electromagnetic coil wound circumferentially around said stationary armature and that is contained within said ferro-magnetic housing, where said coil has a first terminating lead and a second terminating lead that project through said housing, b) an non-magnetic cupped structure sized to fit over said ferro-magnetic housing, with said structure having:

(1) side walls that extend above the edge of the lower can cover of said spray can, (2) means for attaching said cupped structure to said spray can, and (3) a side opening through which extend said pair of coil terminating leads to which are attached a first and second side respectfully of an a-c power connector, where when said movable-armature activator is not connected to an a-c utility power source, the paint pressure in said spray can, in combination with the pressure of said spring located within the spring cavity on the movable armature, maintains said movable armature in a normal, de-energized, upward, closed position causing the compliant pad on said valve leaf to be placed in the closed valve position in which position, paint cannot be sprayed when the spray head is pressed, conversely, when said movable-armature activator is connected to an a-c utility power source, said movable armature is pulled down and said valve leaf overcomes the paint pressure and spring bias allowing said valve leaf to move angularly to the downward, open valve position in which position, paint will flow sequentially through the paint passage bore, the longitudinal paint passage channels, the paint passage bore, the siphon tube cavity, the siphon tube and into the paint passage channel on the spray control valve whereupon, when the spray head is depressed, paint can be sprayed.

17. The utility-power operated, pressurized spray can as specified in claim 16 wherein said valve cavity further comprises a plurality of male detents that extend inward, around the cavity perimeter and said valve housing further comprises a plurality of aligned female detents, where the detent pairs allow said valve housing to remain securely locked when inserted into said valve cavity.

18. The utility-power operated, pressurized spray can as specified in claim 16 wherein said valve housing further comprises an elongated cavity located near the bottom of each said stabilizing protrusion.

19. The utility-power operated, pressurized spray can as specified in claim 16 wherein said activator further comprises a lower compartment in which is housed an electro mechanical assembly having means for allowing the a-c utility power to be applied to the electro-magnetic coil only when a spray can is inserted into said activator and said activator is held above a surface.

20. The utility-power operated, pressurized spray can as specified in claim 19 wherein said electro-mechanical assembly comprises an electronics module that controls the application of the a-c utility power, where said module is energized by an explosion-proof switching circuit, that comprises a reed switch and a permanent magnet, where said switch closes only when said magnet is positioned in alignment with said switch by a reed switch and magnet alignment means.

21. The utility-power operated, pressurized spray can as specified in claim 20 wherein said reed switch and magnet alignment means comprises:

a) a stationary ferromagnetic armature having a substantially centered slide-rod bore therethrough, b) said lower compartment of said activator comprises an upper surface having a substantially centered upper slide-rod bore and a lower cover having a lower slide-rod bore located to one side of said upper slide rod bore, c) a torsion-leaf spring having a lower horizontal section that from a first end extends a first loop having a first terminating end that is attached to said reed switch and from a second end extends a second loop having a second terminating end that is attached to said permanent magnet, when the horizontal section is attached, by an attachment means, to the lower surface of said compartment allowing the first terminating end to be aligned with the lower slide rod bore and the second terminating end to be aligned with the upper slide rod bore, d) a lower slide-rod sized to slidably traverse the lower slide-rod bore on the lower surface of said lower compartment having an upper end that interfaces with the first terminating end of said spring, e) an upper slide rod sized to slidably traverse the slide-rod bore on said armature and the upper slide-rod bore on the upper surface of said lower compartment, with said upper slide rod having a lower end that interfaces with the second terminating end of said spring, where said reed switch and magnet alignment means function in four operating modes:

(1) mode 1: when said spray can is inserted into an activator that is lifted from a surface, said reed switch is aligned with said magnet and said switch closes, (2) mode 2: when said spray can is not inserted into said activator that is lifted from a surface, said reed switch is not aligned with said magnet and therefore, remains open, (3) mode 3: when said spray can is inserted into said activator that is placed on a surface, said reed switch is not aligned with said magnet and therefore, remains open, and (4) mode 4: when said spray can is not inserted into said activator that is lifted from a surface, said reed switch is not aligned with said magnet and therefore, remains open.

22. The utility-power operated, pressurized spray can as specified in claim 21 wherein said electronics module comprises:

a) a triac having an input terminal connected to the first side of said a-c power connector, an output terminal connected to the first terminating lead of said electromagnetic coil, and a gate terminal, where the second side of said a-c power connector in connected to the second terminating lead of said coil, and b) said reed switch having one side connected to the gate terminal of said triac and the other side connected to said triac input terminal, where when said reed switch is aligned with said permanent magnet, said switch closes causing said triac to become enabled which then allows the a-c from the first side of said a-c power connector to be applied to the first terminating lead of said coil.

23. The utility-power operated, pressurized spray can as specified in claim 21 wherein said electronics module comprises;

a) a timing and signal control module having an input terminal connected to the first side of said a-c power connector, an output terminal connected to the first terminating lead of said electromagnetic coil, and a control terminal, where the second side of the a-c power connector is connected to the second terminating end of said coil, and b) said reed switch having one side connected to the control terminal of said module and the other side connected to the input terminal of said module, where when said reed switch is aligned with said permanent magnet said switch closes allowing said module to initially produce a timed d-c output pulse which is applied to the first terminating lead of said electromagnetic coil, and when time has lapsed, said module sequentially produces an output consisting of the a-c power from the first side of said a-c power connector which is applied to the first terminating lead of said coil.

24. The utility-power operated, pressurized spray can as specified in claim 21 wherein said electronics module comprises:

a) a timing and signal control module, having an input terminal connected to the first side of the a-c power connector, an output terminal connected to the first terminating lead of said electromagnetic coil and a control terminal, where the second side of said a-c power connector is connected to the second terminating lead of said coil, b) an AND gate having a first input, a second input and an output that is connected to the control terminal of said module, c) a sine wave detector connected across the first and second sides of said a-c power connector and having an output that is connected to the first input of said AND gate, and d) said reed switch having one side connected to the second input of said AND gate and the other side connected to the output terminal of said module, where when said reed switch is aligned with said permanent magnet, said switch closes allowing said AND gate to become enabled if said sine wave detector is detecting a sine wave, where said enabled AND gate produces an output signal that allows said module to initially produce a timed d-c output pulse which is applied to the first terminating lead of said electromagnetic coil, and when time has lapsed, said module sequentially produces an output consisting of the a-c power from the first side of said a-c power connector which is applied to the first terminating lead of said coil.

* * * * *